US010661565B2

(12) United States Patent
Nakagawa et al.

(10) Patent No.: US 10,661,565 B2
(45) Date of Patent: May 26, 2020

(54) LIQUID EJECTING HEAD AND LIQUID EJECTING APPARATUS

(71) Applicant: CANON KABUSHIKI KAISHA, Tokyo (JP)

(72) Inventors: Yoshiyuki Nakagawa, Kawasaki (JP); Takuro Yamazaki, Inagi (JP); Kazuhiro Yamada, Yokohama (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/000,238

(22) Filed: Jun. 5, 2018

(65) Prior Publication Data

US 2018/0370230 A1 Dec. 27, 2018

(30) Foreign Application Priority Data

Jun. 23, 2017 (JP) ..... 2017-123087

(51) Int. Cl.
*B41J 2/14* (2006.01)

(52) U.S. Cl.
CPC ..... *B41J 2/1433* (2013.01); *B41J 2/1404* (2013.01); *B41J 2002/14403* (2013.01); *B41J 2002/14419* (2013.01); *B41J 2002/14475* (2013.01); *B41J 2202/12* (2013.01)

(58) Field of Classification Search
CPC ..... B41J 2/14233
USPC ..... 347/47
See application file for complete search history.

(56) References Cited

U.S. PATENT DOCUMENTS 6,290,331 B1 * 9/2001 Agarwal ..... B41J 2/14016 347/45
6,938,986 B2 * 9/2005 Macler ..... B41J 2/1433 347/45
9,156,262 B2 10/2015 Taff et al.
2003/0089271 A1 * 5/2003 Hirano ..... C09D 11/037 106/31.9
2006/0152550 A1 * 7/2006 Tomita ..... B41J 2/14056 347/47
2008/0018679 A1 1/2008 Kojima
(Continued)

FOREIGN PATENT DOCUMENTS

CN 1814448 A 8/2006
EP 0 389 738 A2 10/1990
(Continued)

OTHER PUBLICATIONS

Extended European Search Report dated Dec. 11, 2018, in European Patent Application No. 18176944.9.
(Continued)

*Primary Examiner* — Shelby L Fidler
(74) *Attorney, Agent, or Firm* — Venable LLP

(57) ABSTRACT

In a circulating system which circulates liquid within a liquid ejecting head, thickening of liquid in the vicinity of an ejection port section can be more securely suppressed. The ejection port section includes a first ejection port disposed at an upstream side with respect to an ejecting direction of ink and a second ejection port disposed at a downstream side with respect to the ejecting direction. The second ejection port includes an enlarged diameter portion whose diameter is enlarged in a radially outward manner from at least a part of an opening edge portion of the first ejection port.

15 Claims, 15 Drawing Sheets

(56) References Cited

U.S. PATENT DOCUMENTS

| | | | | |
|---|---|---|---|---|
| 2009/0085972 | A1* | 4/2009 | Sim | B41J 2/1606 347/47 |
| 2010/0053270 | A1* | 3/2010 | Xu | B41J 2/1433 347/47 |
| 2010/0208010 | A1* | 8/2010 | Inoue | B41J 2/14145 347/85 |
| 2010/0214334 | A1* | 8/2010 | Kusunoki | B41J 2/04581 347/9 |
| 2011/0205321 | A1 | 8/2011 | Kobayashi et al. | |
| 2012/0098897 | A1 | 4/2012 | Suzuki | |
| 2012/0113197 | A1 | 5/2012 | Kashu et al. | |
| 2012/0162331 | A1* | 6/2012 | Kataoka | B41J 2/175 347/89 |
| 2012/0306969 | A1 | 12/2012 | Kodoi et al. | |
| 2013/0021411 | A1* | 1/2013 | Feinn | B41J 2/1433 347/47 |
| 2015/0290934 | A1 | 10/2015 | Muraoka et al. | |
| 2017/0151784 | A1* | 6/2017 | Giusti | B41J 2/14201 |
| 2017/0197419 | A1 | 7/2017 | Okushima et al. | |
| 2017/0197439 | A1 | 7/2017 | Okushima et al. | |
| 2017/0274647 | A1 | 9/2017 | Aoki et al. | |
| 2017/0326879 | A1* | 11/2017 | Graham | B41J 2/14201 |
| 2018/0162130 | A1 | 6/2018 | Moriya et al. | |
| 2018/0272718 | A1 | 9/2018 | Okushima et al. | |
| 2019/0009534 | A1* | 1/2019 | Sonobata | B41J 2/14209 |

FOREIGN PATENT DOCUMENTS

| | | | |
|---|---|---|---|
| JP | 2002-355973 | A | 12/2002 |
| JP | 2011-062867 | A | 3/2011 |
| JP | 2011-161770 | A | 8/2011 |
| JP | 2012-232552 | A | 11/2012 |
| JP | 2014-024239 | A | 2/2014 |
| WO | 2010/044775 | A1 | 4/2010 |
| WO | 2012/058016 | A1 | 5/2012 |

OTHER PUBLICATIONS

U.S. Appl. No. 15/992,667, Takuro Yamazaki Tom Nakakubo Kazuhiro Yamada Yoshiyuki Nakagawa Yoshihiro Hamada Koichi Ishida Shingo Okushima, filed May 30, 2018.

U.S. Appl. No. 16/014,600, Akiko Hammura Yoshiyuki Nakagawa, filed Jun. 21, 2018.

Office Action dated Mar. 24, 2020, in Chinese Patent Application No. 201810652511.X.

* cited by examiner

LIQUID EJECTING HEAD AND LIQUID EJECTING APPARATUS

BACKGROUND OF THE INVENTION

Field of the Invention

The present invention relates to a liquid ejecting head which can eject liquid such as ink and a liquid ejecting apparatus.

Description of the Related Art

In a print head (liquid ejecting head) included in an inkjet printing apparatus as a liquid ejecting apparatus, ink in the vicinity of an ejection port thickens as a result of evaporation of a volatile component included in ink from the ejection port in which liquid ink is to be ejected. In a case where such thickening of ink occurs, an ink ejection speed and an ink ejecting direction from the ejection port are changed and the landing accuracy of ink droplets may be possibly affected. Particularly, in a case where pause time of not ejecting ink is long, the increase of the viscosity of ink is remarkable and the solid component of ink adheres to the vicinity of the ejection port, thereby increasing fluid resistance of ink and possibly inducing failure of ink ejection.

Japanese Patent Laid-Open No. 2002-355973 discloses a configuration of circulating ink within a print head for suppressing thickening of ink along with evaporation of a volatile component of ink from an ejection port.

However, the present inventors have found out, as a result of the study, that the mere configuration of circulating ink as disclosed in Japanese Patent Laid-Open No. 2002-355973 may have a possibility of causing color unevenness on a printed image due to a change in concentration of a coloring material in ink. Particularly, in a case where at least one of the following conditions is satisfied, that is, a case where the volume of an ink droplet to be ejected is small, a case where the print head has a high temperature, and a case where a solid component of ink is high, the concentration of the coloring material in ink has been changed, and thus the color unevenness on a printed image has likely occurred.

SUMMARY OF THE INVENTION

The present invention provides a liquid ejecting head and a liquid ejecting apparatus which can suitably suppress thickening of liquid in the vicinity of an ejection port in a circulating system which circulates liquid within the liquid ejecting head.

In the first aspect of the present invention, there is provided a liquid ejecting head comprising:

- a pressure chamber to which liquid flows in through an inflow path and from which the liquid flows out through an outflow path;
- an ejection port which is communicated with the pressure chamber; and
- an ejection energy generating element for causing the liquid in the pressure chamber to be ejected from the ejection port, wherein
- the ejection port includes a first ejection port disposed in an upstream side in an ejecting direction of liquid and a second ejection port disposed in a downstream side in the ejecting direction, and
- the second ejection port includes an enlarged diameter portion whose diameter is enlarged in a radially outward manner from at least a part of an opening edge portion of the first ejection port.

In the second aspect of the present invention, there is provided a liquid ejecting head comprising:

- an ejection port through which liquid is ejected;
- a pressure chamber which is communicated with the ejection port and which includes an ejection energy generating element inside the pressure chamber for generating energy to be used for ejecting liquid;
- a first flow path which is communicated with the pressure chamber and through which liquid is supplied to the pressure chamber;
- a second flow path which is communicated with the pressure chamber and through which liquid is collected from the pressure chamber, wherein
- the ejection port includes a first ejection port which is disposed in an upstream side in an ejecting direction of liquid and in which liquid meniscus is formed and a second ejection port disposed in a downstream side of the ejecting direction, and
- an opening diameter of the second ejection port is larger than an opening diameter of the first ejection port.

In the third aspect of the present invention, there is provided a liquid ejecting apparatus comprising:

- a liquid ejecting head of the first aspect of the present invention;
- a liquid supplying flow path for supplying liquid to the liquid ejecting head;
- a liquid collecting flow path for collecting liquid from the liquid ejecting head; and
- a control unit for controlling the ejection energy generating element of the liquid ejecting head.

According to the present invention, by specifying a configuration of the ejection port in the circulating system which circulates liquid within the liquid ejecting head, the thickening of liquid in the vicinity of the ejection port can be suitably suppressed. In a case where the liquid ejecting head is a print head that ejects liquid ink, the thickening of ink in the vicinity of the ejection port can be suppressed to print an image of a high quality.

Further features of the present invention will become apparent from the following description of exemplary embodiments with reference to the attached drawings.

DESCRIPTION OF THE EMBODIMENTS

A liquid ejecting head and a liquid ejecting apparatus in the following embodiments are application examples as an inkjet print head which can eject liquid ink and an inkjet printing apparatus.

(Configuration of Printing Apparatus)

Figure 1A:
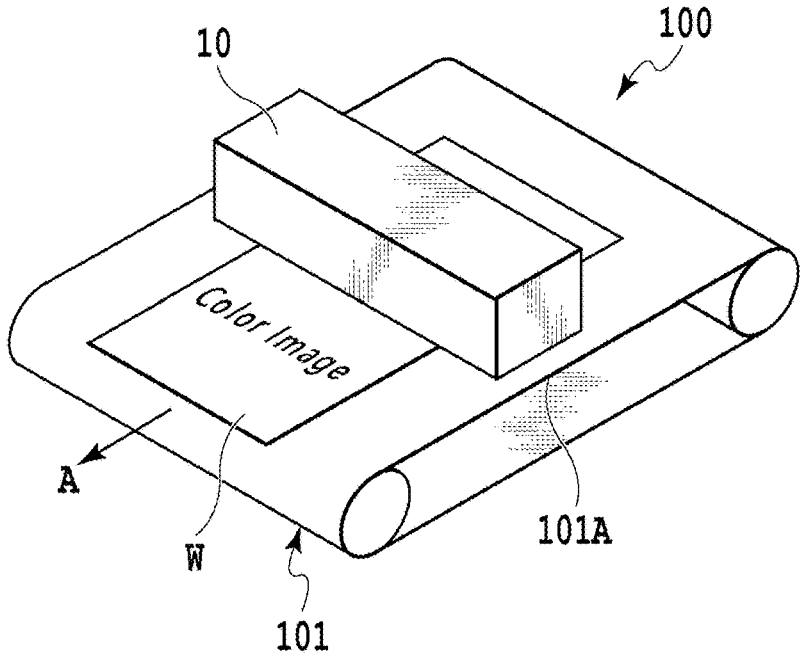
FIGS. 1A and 1B are schematic configuration diagrams each showing a printing apparatus applicable to the present invention.

FIG. 1A is a schematic perspective view of major parts for illustrating a basic configuration of an inkjet printing apparatus (liquid ejecting apparatus) 100 applicable to the present invention. The printing apparatus 100 of this example is a printing apparatus of a so-called full line system, which includes a conveying unit 101 which conveys a print medium W in a conveying direction of an arrow A and an inkjet print head (liquid ejecting head) 10 capable of ejecting ink (liquid). The conveying unit 101 of this example conveys the print medium W by using a conveying belt 101A. The print head 10 is a print head of a line type (page-wide type) extending in a direction crossing (orthogonal in the case of this example) the conveying direction of the print medium W, and has a plurality of ejection ports capable of ejecting ink arranged along the width direction of the print medium W. As for the print head 10, ink is supplied from a non-illustrated ink tank through an ink supply unit composed of ink flow paths. By ejecting ink from the ejection ports of the print head 10 based on print data (ejection data) while continuously conveying the print medium W, an image is printed on the print medium W. The print medium W is not limited to a cut sheet, and may be an elongate roll sheet.

Figure 1B:
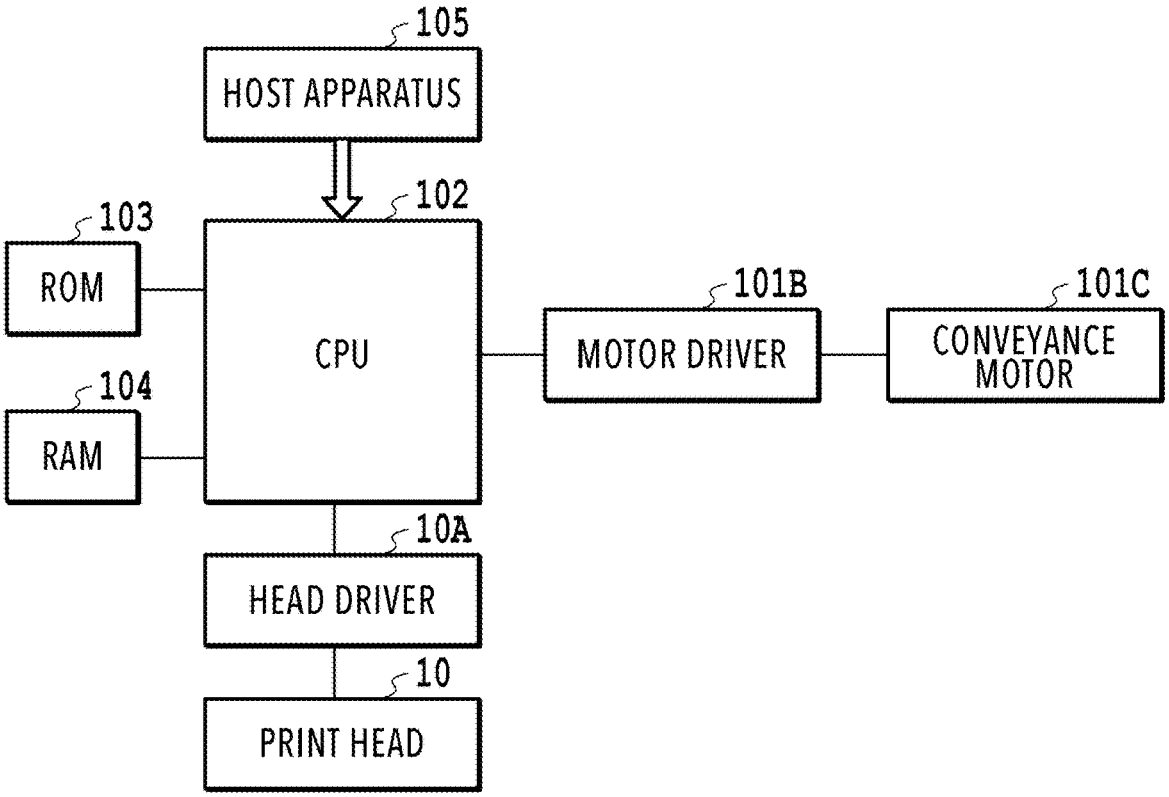

FIG. 1B is a block diagram for illustrating a configuration example of a control system of the printing apparatus 100. A CPU (control unit) 102 executes control processing on operation of the printing apparatus 100, data processing, and the like. In a ROM 103, a program including procedures for such processing is stored. A RAM 104 is used as a work area for executing such processing. The print head 10 includes the plurality of ejection ports, the plurality of ink flow paths that are communicated with the respective ejection ports, and a plurality of ejection energy generating elements arranged for the respective ink flow paths. The ejection ports, the ink flow paths, and the ejection energy generating elements form a plurality of nozzles capable of ejecting ink. These nozzles function as printing elements. As for the ejection energy generating elements, an electrothermal transducing element (heater) and a piezoelectric element, for example, may be used. In the case of using the electrothermal transducing element, ink in the ink flow paths is bubbled by the heating of the electrothermal transducing element, and the resultant bubble energy is used to eject ink from the ejection port. The ejection of ink from the print head 10 is made such that the CPU 102 drives the ejection energy generating elements via a head driver 10A based on image data to be inputted from a host apparatus 105 or the like. The CPU 102 drives a conveyance motor 101C in the conveying unit 101 via a motor driver 101B.

(Configuration of Ink Supply System)

Figure 2:
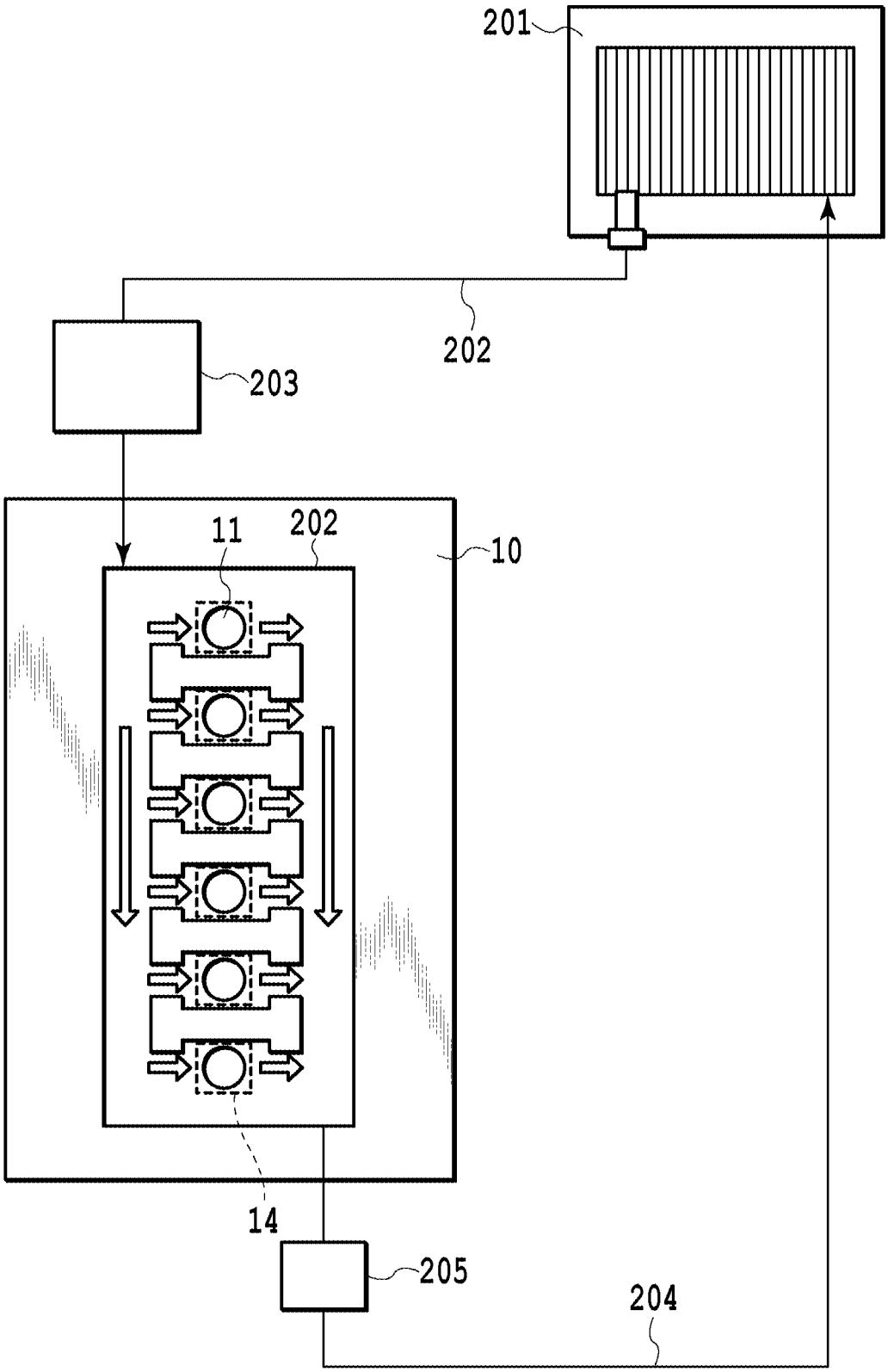
FIG. 2 is a diagram illustrating an ink supply system in the printing apparatus of FIG. 1A.

FIG. 2 is a schematic diagram of the ink supply system for supplying ink to the print head 10 in the present embodiment. Ink in an ink tank 201 is supplied to the print head 10 through an ink supplying flow path (liquid supplying flow path) 202. A part of ink supplied to the print head 10 is ejected from an ejection port 11 and other ink is collected by the ink tank 201 through an ink collecting flow path (liquid collecting flow path) 204. By using a negative pressure adjustment device 203 included in the ink supplying flow path 202 and a fixed flow rate pump 205 included in the ink collecting flow path 204, ink pressure in the ejection port 11 is adjusted while inducing circulation flow of ink between the ink tank 201 and the print head 10. The fixed flow rate pump 205 and the negative pressure adjustment device 203 which generate ink circulation flow can be integrally provided with the print head 10, or can be attached to the outside of the print head 10 so as to be connected with the print head 10 via a supply tube or the like. Alternatively, the fixed flow rate pump 205 and the negative pressure adjustment device 203 can be incorporated into a printing element substrate as a MEMS element such as a micropump. As will be described later, the present invention can be suitably applied to the liquid ejecting head and the liquid ejecting apparatus having a form of supplying liquid to a pressure chamber R which provides the energy generating elements therein and causing the ink not ejected from the ejection ports to flow outside the pressure chamber R from the inside. The configuration of FIG. 2 is one example of generating ink flow, but other configurations can be applied as well. For instance, the present invention can also be applied to a case of forming the above ink flow by providing a microactuator within the print head 10 in place of the fixed flow rate pump 205 of FIG. 2.

(Configuration of Print Head)

Figure 3A:
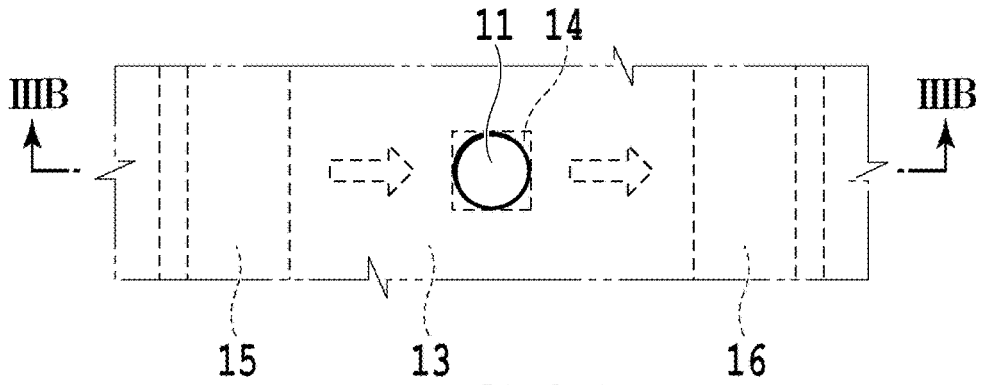
FIGS. 3A, 3B, and 3C are configuration diagrams each showing major parts of a print head in a first embodiment of the present invention.
Figure 3B:
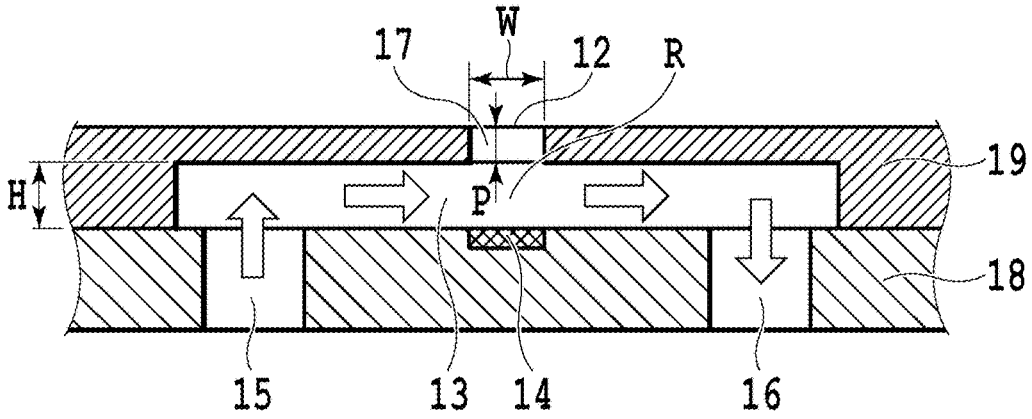
Figure 3C:
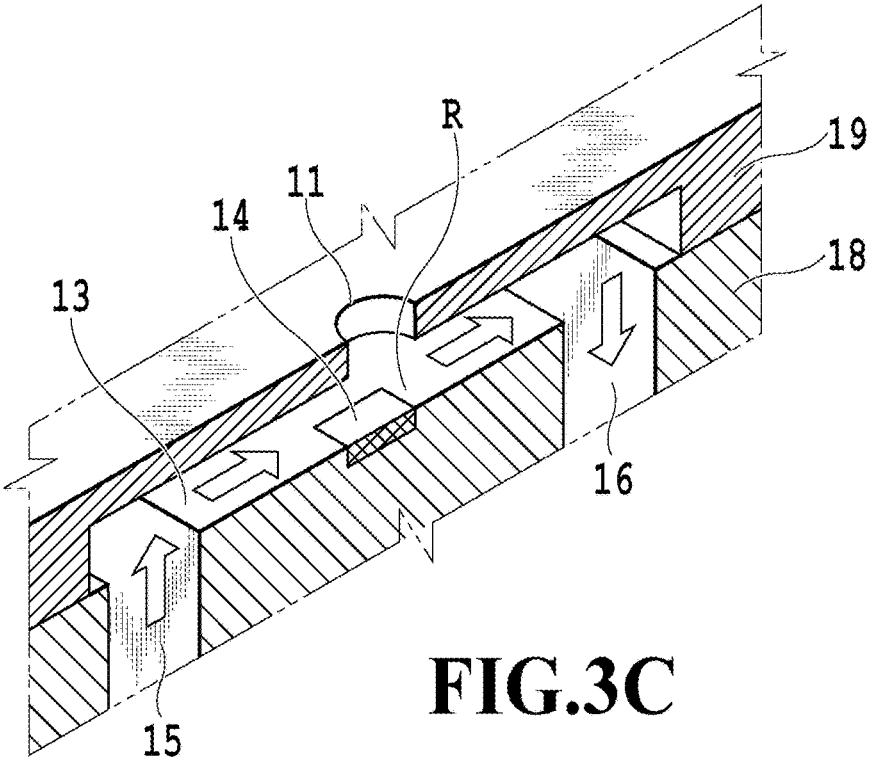

FIGS. 3A, 3B, and 3C are diagrams illustrating parts in the vicinity of the ejection port 11 in the print head 10. FIG. 3A is a plan view of the major parts of the print head 10 viewed from the ejection port 11, FIG. 3B is a cross-sectional view taken from line IIIB-IIIB of FIG. 3A, and FIG. 3C is a perspective view of a cross section of the major parts of the print head 10.

In the print head 10 of this example, the ejection port 11, a flow path 13, and an electrothermal transducing element (heater) 14 as an ejection energy generating element are formed. In the flow path 13, ink is supplied from its one end to the other end. In an area between one end and the other end of the flow path 13, the pressure chamber R and the ejection port 11 which is communicated with the pressure chamber R are formed. The flow path 13 includes a first flow path provided in an upstream side of the pressure chamber R and a second flow path provided in a downstream side thereof. Ink supplied to the pressure chamber R through the first flow path is collected to the outside of the pressure chamber R through the second flow path. In the ejection port 11, an interface 12 is formed between ink and atmosphere as a result of meniscus of ink. Ink can be ejected from the ejection port 11 by making ink in the pressure chamber R bubbled by the heating of the heater 14 and by using the resultant bubble energy. The ejection energy generating element is not limited only to the heater 14, but various energy generating elements such as the piezoelectric element, for example, may be used.

In an element substrate 18 of the print head 10, an inflow path 15 and an outflow path 16 which extend in directions that intersect the flow path 13 are formed as through holes. The inflow path 15 is communicated with the ink supplying flow path 202 of FIG. 2 and the outflow path 16 is communicated with the ink collecting flow path 204 of FIG. 2. Accordingly, in the print head 10, as shown with arrows in FIG. 3B, ink is circulated through the ink supplying flow path 202, the inflow path 15, one end side of the flow path 13, the ejection port 11, the other end side of the flow path 13, the outflow path 16, and the ink collecting flow path (liquid collecting flow path) 204. In the case of this example, in a state in which ink flows within the flow path 13, ink can be ejected from the ejection port 11 by driving the heater 14. The flow rate of ink circulation flow within the flow path 13 is, for example, about 0.1 mm/s to 100 mm/s. Even if ink ejection operation is performed in the state in which ink flows within the flow path 13, its effect on the landing accuracy of ink droplets, for example, is low. The pressure chamber R allows the ink flow of such a flow rate, thereby forming meniscus of the ink in the ejection port 11.

The heater 14 is formed in the element substrate 18 made of silicon (Si). The ejection port 11 and an ejection port part 17 communicating between the ejection port 11 and the flow path 13 are formed in an orifice plate 19. The ejection port 11 is an opening formed on the surface of the orifice plate 19 (ejection port forming face), and the ejection port part 17 is a cylindrical communication part connecting between the ejection port 11 and the flow path 13.

(Relation of Dimensions (P, W, and H) in Print Head)

As shown in FIG. 3B, a height of the flow path 13 in the upstream side (the left side in FIG. 3B) in an ink flowing direction with respect to the communication part between the flow path 13 and the ejection port part 17 is denoted as H, and a length of the ejection port part 17 in an ink ejecting direction is denoted as P. Further, a width of the ejection port part 17 in the ink flowing direction in the flow path 13 is denoted as W. In this example, a height H is 3 to 30 μm, a length P is 3 to 30 μm, and a width W is 6 to 30 μm. Ink to be used is adjusted such that the concentration of a non-volatile solvent is 30%, the concentration of the coloring material is 3%, and viscosity is 0.002 to 0.003 Pa·s.

Figure 4A:
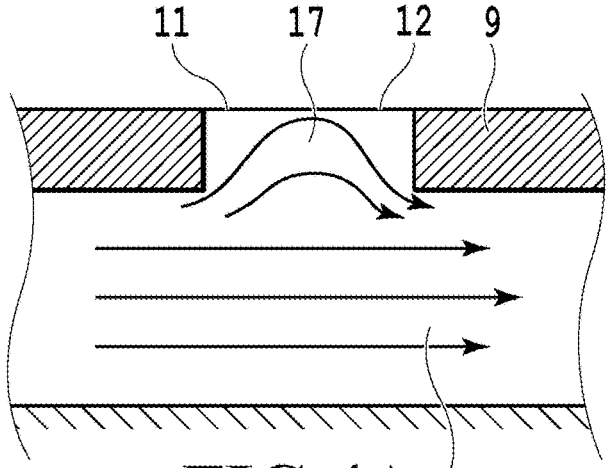
FIGS. 4A, 4B, and 4C are diagrams each illustrating ink flow in the vicinity of an ejection port part of the print head of FIG. 3A.

FIG. 4A is a diagram illustrating ink flow in the ejection port 11, the ejection port part 17, and the flow path 13 in the case where ink circulation flow within the print head 10 is in a stationary state. The lengths of vectors shown in FIG. 4A do not represent the amount of speed and are unrelated to all speed values. In FIG. 4A, with respect to the print head 10 having a height H of 14 μm, a length P of 5 μm, and a width W of 12.4 μm, the flow of ink flowing into the flow path 13 from the inflow path 15 at a speed of 1.26×10-4 ml/min is shown with arrows.

In this example, a case where the concentration of the coloring material in ink has been changed as a result of evaporation of the ink volatile component from the ejection port 11 is considered so as to suppress such ink from being retained in the ejection port 11 and the ejection port part 17. In order to achieve this, as shown in FIG. 4A, part of the ink circulation flow within the flow path 13 is caused to enter the inside of the ejection port part 17. Then, after the ink inside the ejection port part 17 reaches the vicinity of the interface 12, the ink is returned from the ejection port part 17 to the flow path 13. The ink returned to the flow path 13 passes through the outflow path 16 and then through the ink collecting flow path 204 shown in FIG. 2 for circulation. As such, the part of the ink circulation flow enters the inside of the ejection port part 17 and reaches a position in the vicinity of ink meniscus (interface 12) formed on the ejection port 11, and then returns to the flow path 13. Due to this movement, not only ink inside the ejection port part 17 which is likely to be influenced by evaporation of the ink volatile component, but also ink in the vicinity of the interface 12 which is significantly influenced in particular by such evaporation can be prevented from being retained inside the ejection port part 17 and can flow out to the flow path 13.

Ink flow in at least a center part in the vicinity of the interface 12 (the center part of the ejection port 11) has a velocity component (hereinafter referred to as a "positive velocity component") in the ink flowing direction inside the flow path 13 (from the left side to the right side in FIG. 4A) as shown in FIG. 4A. In the following descriptions, as shown in FIG. 4A, a mode of ink flow having the positive velocity component at the center part in the vicinity of the interface 12 is represented as a "flow mode A". Further, as in comparison examples shown in FIG. 5B and FIG. 5D to be described later, a mode of ink flow having a "negative velocity component" which is the opposite of the positive velocity component at the center part in the vicinity of the interface 12 is represented as a "flow mode B".

As a result of the study by the inventors, the print head of the flow mode A is found to satisfy the following relational expression (1). As described above, the print head of the flow mode A can prevent the ink in which the concentration of the coloring material has been changed as a result of evaporation of the ink volatile component from being retained inside the ejection port 11 and can cause such ink to flow out to the flow path 13. Specifically, the print head of the flow mode A satisfies the following relational expression (1) for a height H (μm), a length P (μm), and a width W (μm) shown in FIG. 3B:

$$H^{-0.34}\times P^{-0.66}\times W>1.7 \tag{1}$$

The left side of the relational expression (1) is represented as a determination value J. It is found that the print head of the flow mode A as in FIG. 4A satisfies the relational expression (1), whereas the print head of the flow mode B does not satisfy the relational expression (1).

Figure 4B:
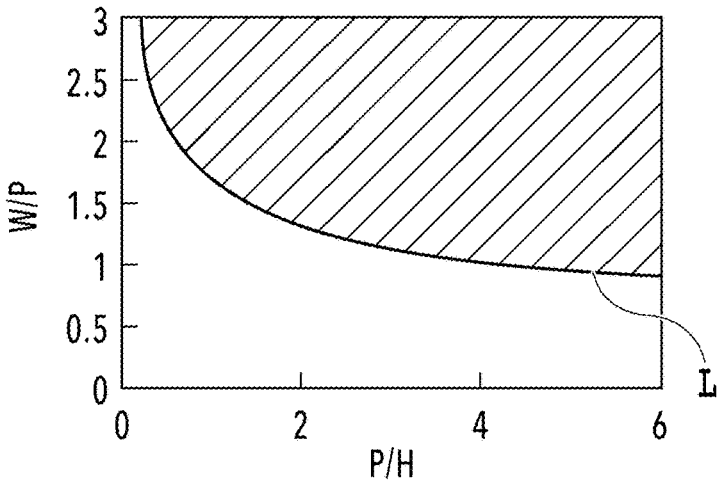

FIG. 4B is a graph illustrating the relation between the print head of the flow mode A and the print head of the flow mode B. A horizontal axis in FIG. 4B indicates the ratio of a length P to a height H (P/H) and a vertical axis therein indicates the ratio of a width W to a length P (W/P). A line L indicated in FIG. 4B represents a threshold line that satisfies the following relational expression (2).

$$\left(\frac{W}{P}\right)=1.7\times\left(\frac{P}{H}\right)^{-0.34} \tag{2}$$

It is found that a print head having the relation of H, P, and W which falls within a range of an upper part of the threshold line L (a diagonally shaded area in FIG. 4B) is in the flow mode A, whereas a print head having the relation of H, P, and W which falls within a range of a lower part of the threshold line L is in the flow mode B. To be more specific, a print head that satisfies the following relational expression (3) will be in the flow mode A.

$$\left(\frac{W}{P}\right) > 1.7 \times \left(\frac{P}{H}\right)^{-0.34} \quad (3)$$

Sorting the relational expression (3) leads to the relational expression (1), and therefore, a print head (the one having the determination value J of 1.7 or more) having the relation of H, P, and W which satisfies the relational expression (1) will be in the flow mode A.

Figure 4C:
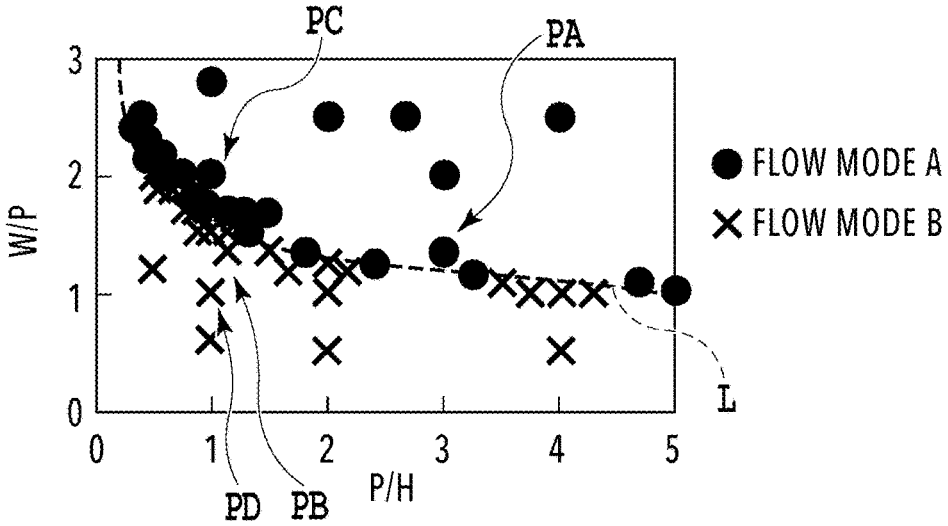

FIG. 5A, FIG. 5B, FIG. 5C, and FIG. 5D are diagrams illustrating ink circulation flow in the vicinity of various types of ejection ports 11 in different print heads. FIG. 4C is a graph illustrating determination results of the flow modes for the plurality of print heads including those shown in FIG. 5A, FIG. 5B, FIG. 5C, and FIG. 5D. A dot mark (•) in the diagram indicates a print head that has been determined to be in the flow mode A, whereas an x mark (x) therein indicates a print head that has been determined to be in the flow mode B.

Figure 5A:
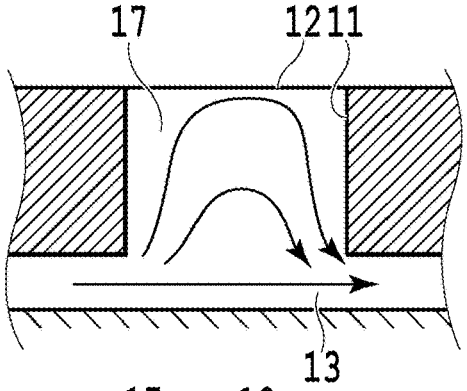
FIGS. 5A, 5B, 5C, and 5D are diagrams illustrating ink flow in the vicinity of respective ejection ports in different print heads.
Figure 5B:
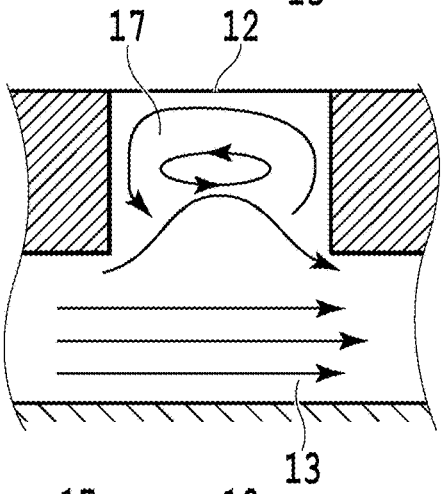
Figure 5C:
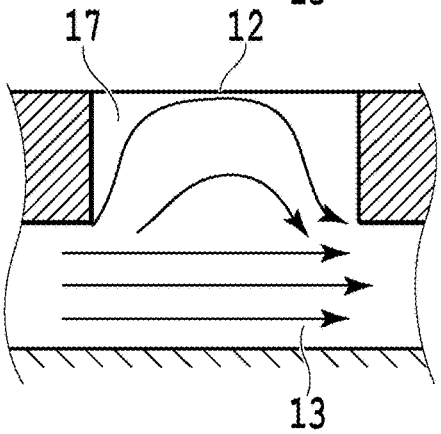
Figure 5D:
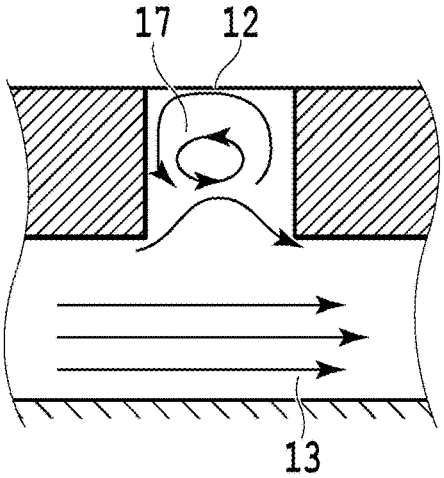

The print head of FIG. 5A has the height H of 3 μm, the length P of 9 μm, and the width W of 12 μm, and the determination value J on the left side of the relational expression (1) is 1.93, which is larger than 1.7. As a result of confirming an actual flow of the circulation flow in this print head, the flow mode A as shown in FIG. 5A has been found. The determination result of this print head corresponds to a point PA in FIG. 4C. A print head of FIG. 5B has the height H of 8 μm, the length P of 9 μm, and the width W of 12 μm, and the determination value J is 1.39, which is smaller than 1.7. As a result of confirming an actual flow of the circulation flow in this print head, the flow mode B as shown in FIG. 5B has been found. The determination result of this print head corresponds to a point PB in FIG. 4C. A print head of FIG. 5C has the height H of 6 μm, the length P of 6 μm, and the width W of 12 μm, and the determination value J is 2.0, which is larger than 1.7. As a result of confirming an actual flow of the circulation flow in this print head, the flow mode A as shown in FIG. 5C has been found. The determination result of this print head corresponds to a point PC in FIG. 4C. A print head of FIG. 5D has the height H of 6 μm, the length P of 6 μm, and the width W of 6 μm, and the determination value J is 1.0, which is smaller than 1.7. As a result of confirming an actual flow of the circulation flow in this print head, the flow mode B as shown in FIG. 5D has been found. The determination result of this print head corresponds to a point PD in FIG. 4C.

As such, the print head of the flow mode A and the print head of the flow mode B can be classified based on a boundary of the threshold line L indicated in FIG. 4B. Specifically, a print head having the determination value J larger than 1.7 in the relational expression (1) belongs to the flow mode A, and such a print head has the positive velocity component for the ink flow in at least the center part of the interface 12.

The ink flow of the ejection port part belonging to either the flow mode A or the flow mode B is predominantly affected by the above relation of P, W, and H. An influence caused by other conditions besides the condition associated with the relation of P, W, and H, such as a flow rate of the ink circulation flow, a viscosity of ink, a flow direction of the circulation flow, and a width of the ejection port 11 in a direction orthogonal to the width W, is extremely smaller than the influence caused by the relation of P, W, and H. Accordingly, the flow rate of the ink circulation flow and the viscosity of ink may be appropriately set in accordance with the specifications of a required print head and printing apparatus and their use environment conditions. For instance, the flow rate of the ink circulation flow in the flow path 13 can be set to be 0.1 to 100 mm/s, and the viscosity of ink can be set to be 10 cP or less. Further, in a case where the evaporation rate of the ink volatile component from the ejection port is increased due to a change in the use environment or the like, a flow amount of the ink circulation flow can be appropriately increased to make the ink flow belong to the flow mode A. With respect to the print head of the flow mode B, even if the flow amount of ink circulation flow is increased as much as possible, a mode is not changed to the flow mode A. In other words, whether a print head belongs to the flow mode A or the flow mode B is not determined by conditions such as the flow rate of ink and the viscosity of ink, but is predominantly determined by the condition associated with the relation of H, P, and W. In addition, among print heads of the flow mode A, a print head having the height H of 20 μm or less, the length P of 20 μm or less, and the width W of 30 μm or less, in particular, is preferable because such a print head is capable of printing finer images.

(Relation Between Ink Evaporation Speed and Circulation Flow)

Figure 6A:
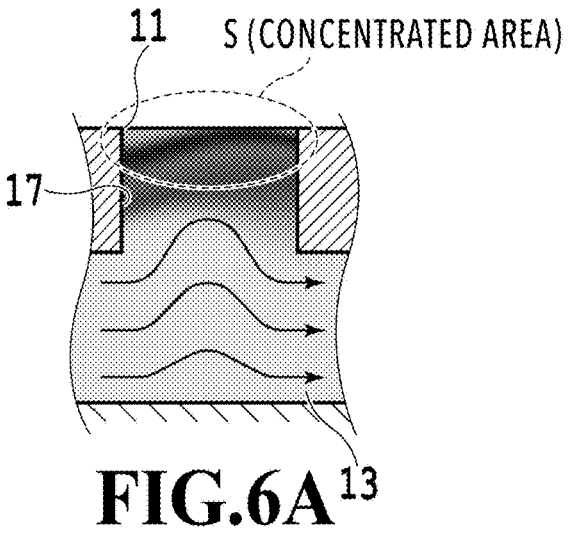
FIGS. 6A, 6B, and 6C are diagrams illustrating ink flow in the respective print heads and the rate of evaporation of a volatile component of ink from the ejection port.
Figure 6B:
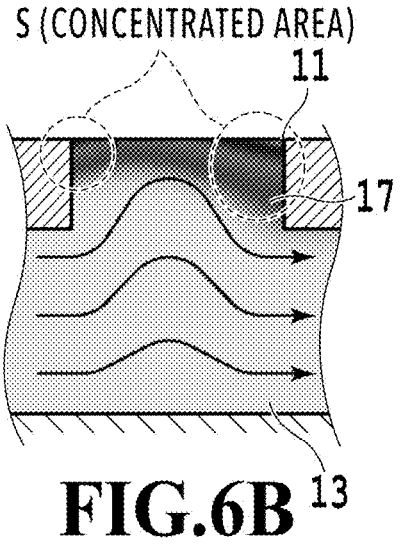

FIG. 6A is a diagram illustrating the state of concentrated ink in the print head of the flow mode B (J=1.3) and FIG. 6B is a diagram illustrating the state of concentrated ink in the print head of the flow mode A (J=2.3). In the print head of the flow mode B, as shown in FIG. 6A, the ink circulation flow is unlikely to enter the ejection port part 17 and a concentrated area S in which ink is concentrated is large. Meanwhile, in the print head of the flow mode A, as shown in FIG. 6B, the ink circulation flow is likely to enter the ejection port part 17. However, as in FIG. 6B, in the vicinity of an opening edge portion of the ejection port 11, that is, in particular, at a position of the downstream side in an ink flow direction inside the ejection port part 17, there is a possibility of occurrence of the concentrated area S in which ink is likely to be retained. In a case where such concentrated area S has occurred, the ink in the vicinity of the opening edge portion of the ejection port 11 is thickened, and in a case where the solid content of ink is high (for example, in the case of 8 wt % or more), in particular, there may be a concern that the ink is unlikely to be normally ejected.

Figure 6C:
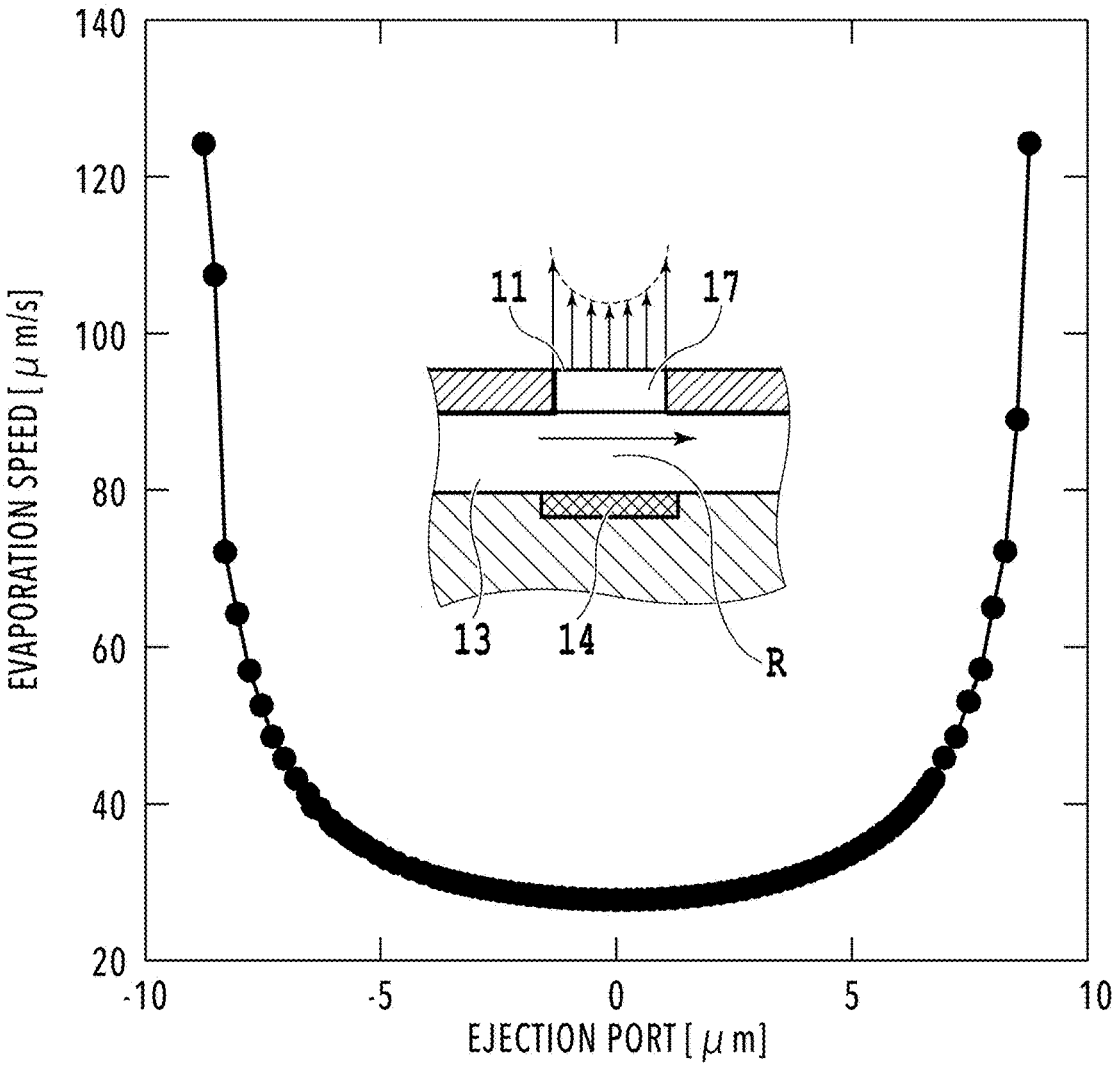

As described above, in the print head of the flow mode A, the ink circulation flow reaches the vicinity of the interface 12 to have the positive velocity component. Accordingly, the ink inside the ejection port part 17, or the ink in the vicinity of the interface 12, in particular, can be easily replaced with ink in the flow path 13, and can reduce the retention of the ink inside the ejection port part 17. Therefore, the influence of the evaporation of the ink volatile component from the ejection port 11, that is, the increase of the concentration of the coloring material in the ink inside the ejection port part 17 can be alleviated. However, as shown in FIG. 6B, even if the ink circulation flow exists inside the ejection port part 17, there is a possibility of occurrence of the ink retention in the vicinity of the opening edge portion of the ejection port 11. Reasons for this are that, due to the viscosity of ink, the ink circulation flow is unlikely to occur in the vicinity of the opening edge portion of the ejection port 11, and that the evaporation rate of the ink volatile component at the opening edge portion of the ejection port 11 is too high so that the ink is apt to thicken in the vicinity of the opening edge portion of the ejection port 11. In FIG. 6C, a horizontal axis indicates positions of the ejection port 11 in its width direction by assuming a central position of the ejection port 11 as a fiducial point, whereas a vertical axis indicates evaporation speeds of the ink volatile component at corresponding positions. As shown in FIG. 6C, the evaporation speed for the opening edge portion of the ejection port 11 is high. This is because that, as will be described later, ink from the opening edge portion of the ejection port 11 is apt to be diffused compared to the ink at the central part of the ejection port 11. As such, the evaporation rate of the ink volatile component at the opening edge portion of the ejection port 11 is high and the ink circulation flow is unlikely to occur, and therefore, the ink in the vicinity of the opening edge portion of the ejection port 11 is apt to be concentrated.

In the present embodiment, for suppressing such evaporation rate of the ink volatile component at the opening edge portion of the ejection port 11, besides the ejection port 11 and the ejection port part 17, an ejection port and an ejection port part in which an ink meniscus interface is not formed in a stationary state are newly provided. Hereinafter, the former ejection port 11 and ejection port part 17 are referred to as a first ejection port and a first ejection port part, whereas the latter ejection port and ejection port part are referred to as a second ejection port and a second ejection port part.

Figure 7A:
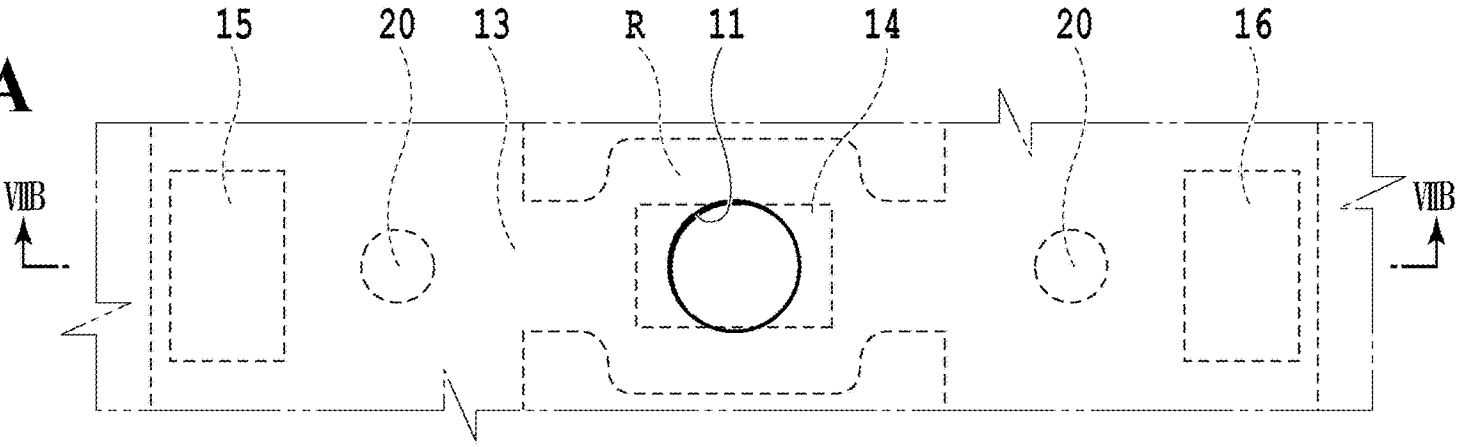
FIGS. 7A and 7B are diagrams each illustrating the print head including an ejection port of a form A.
Figure 7B:
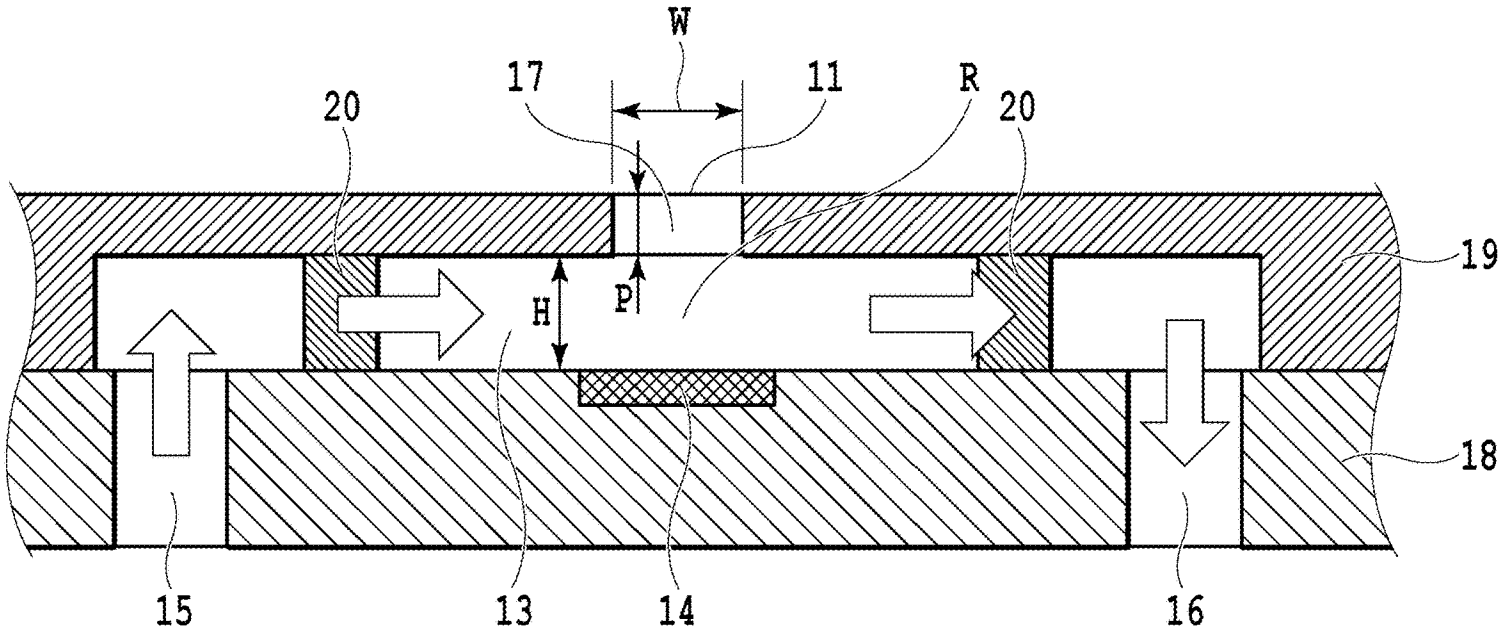
Figure 8A:
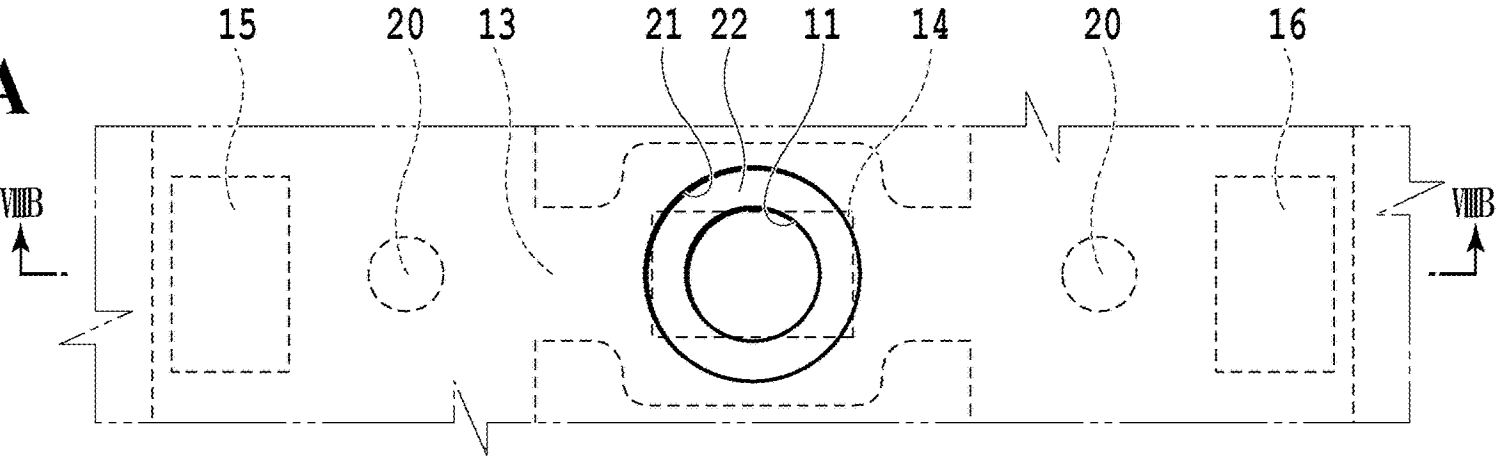
FIGS. 8A and 8B are diagrams each illustrating the print head including an ejection port of a form B.
Figure 8B:
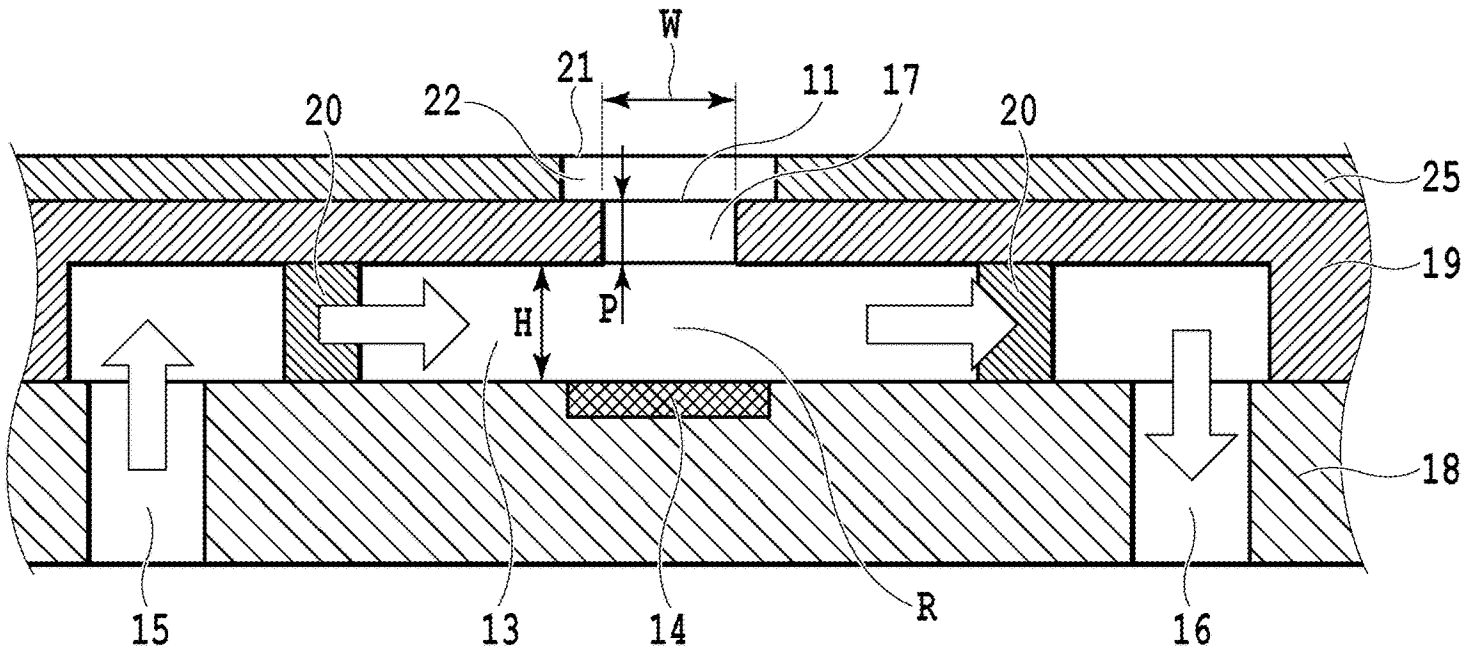

In this example, with respect to the print head in which the first ejection port 11 and the first ejection port part 17 are formed as shown in FIGS. 7A and 7B, second ejection ports 21, 23 and second ejection port parts 22, 24 as shown in FIGS. 8A and 8B and FIGS. 9A and 9B are respectively provided. It should be noted that columns 20 constituting filters are formed between the element substrate 18 and the orifice plate 19. An opening diameter of the second ejection port 21 in FIGS. 8A and 8B is larger than that of the first ejection port 11, and the second ejection port part 22 communicating between the second ejection port 21 and the first ejection port 11 extends in a straight manner in an ink ejecting direction. The second ejection port 23 shown in FIGS. 9A and 9B has a larger diameter than that of the first ejection port 11, and the second ejection port part 24 communicating between the second ejection port 23 and the first ejection port 11 includes an inclined face which is inclined radially outward along a direction from the first ejection port 11 to the second ejection port 23. The inclined face in the second ejection port part 24 of this example is a concave face along a curve line (for example, a catenary curve). These second ejection ports 21, 23 and ejection port parts 22, 24 are formed on a second orifice plate 25 which is located above the orifice plate 19. Hereinafter, the forms of ejection ports shown in FIGS. 7A and 7B, FIGS. 8A and 8B, and FIGS. 9A and 9B are referred to as a form A, a form B, and a form C, respectively.

Figure 9A:
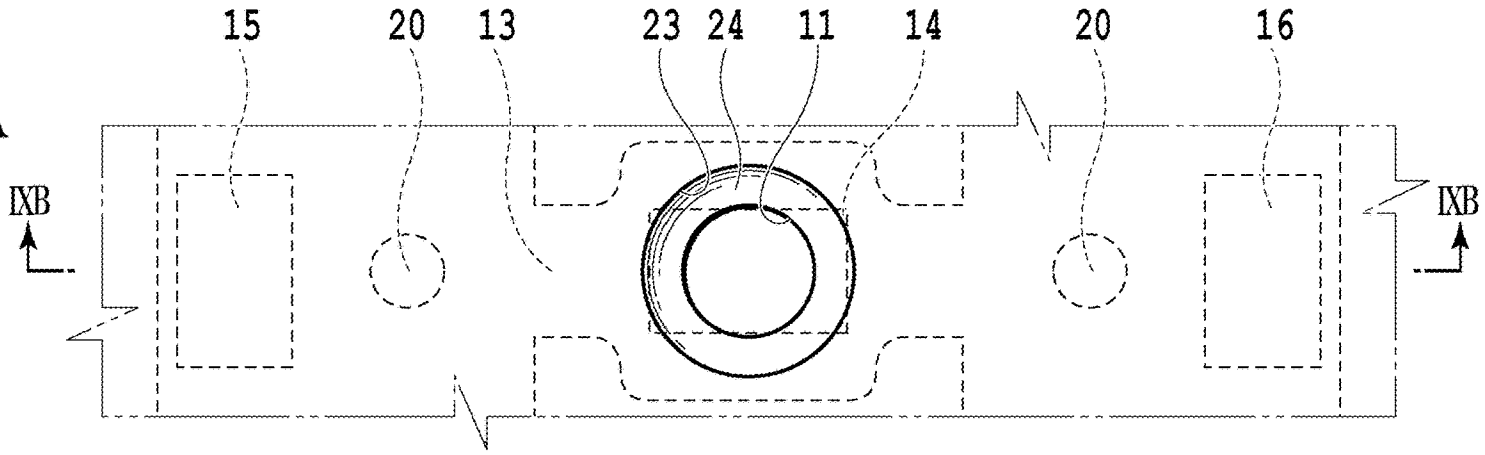
FIGS. 9A and 9B are diagrams each illustrating the print head including an ejection port of a form C.
Figure 9B:
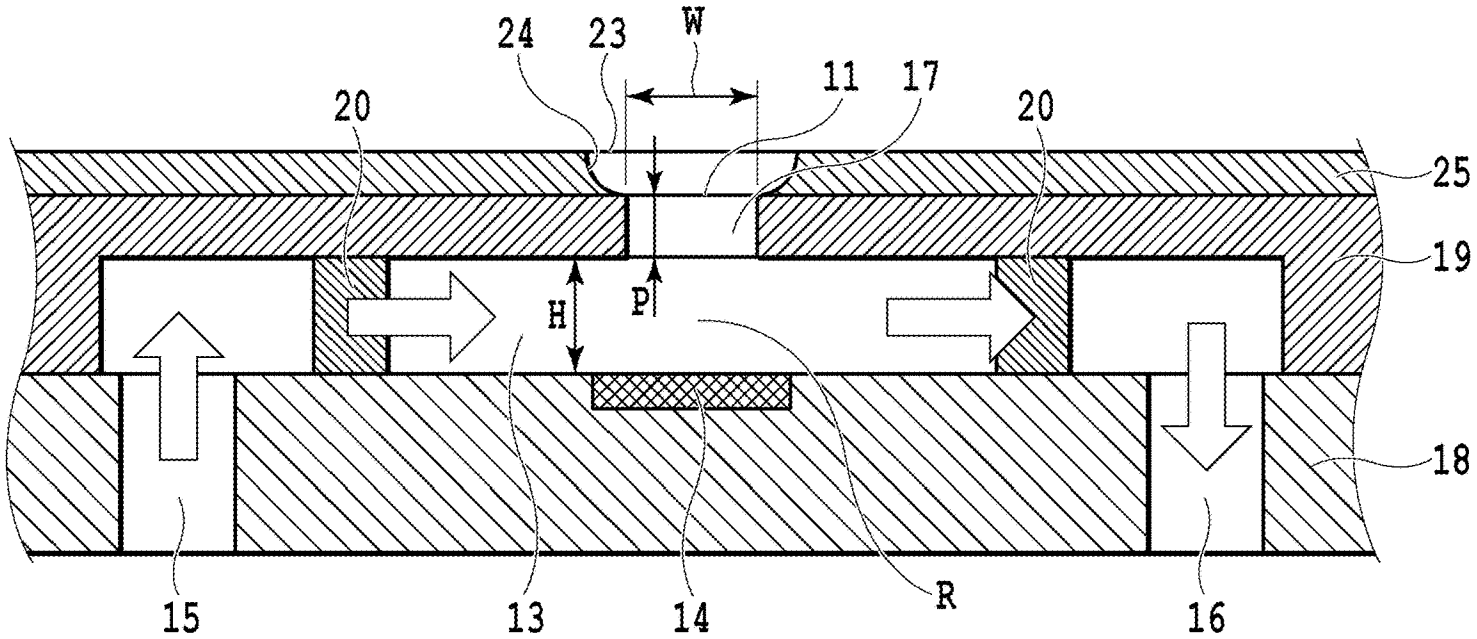

The second ejection ports 21, 23 in this example have cross-sectional circular shapes which are identical to that of the first ejection port 11, and their central axes are identical to that of the first ejection port 11. Therefore, those second ejection ports 21, 23 include enlarged diameter portions in which diameters are enlarged in a radially outward manner from the opening edge portion of the first ejection port 11. The enlarged diameter portion is located at the entire perimeter of the opening edge portion of the first ejection port 11. Such an enlarged diameter portion may not necessarily be located at the entire perimeter of the opening edge portion of the first ejection port 11, but may be enlarged radially outward from at least a part of the opening edge portion of the ejection port 11. As described above, since ink is apt to be retained in the downstream side in the ink flow direction inside the ejection port part 17, it is preferable that the enlarged diameter portion be located at least in the downstream side of the flow direction. Further, the shapes of the first ejection port and the second ejection port are not limited to a circular shape as shown in FIG. 9A, but may be, for example, an oval shape. In addition, as will be described later with reference to FIGS. 15A and 15B, their shapes may be an ejection port shape including a plurality of protrusions extending from the outer edge of the ejection port toward a center thereof.

(Print Head of Flow Mode B)

Figure 10A:
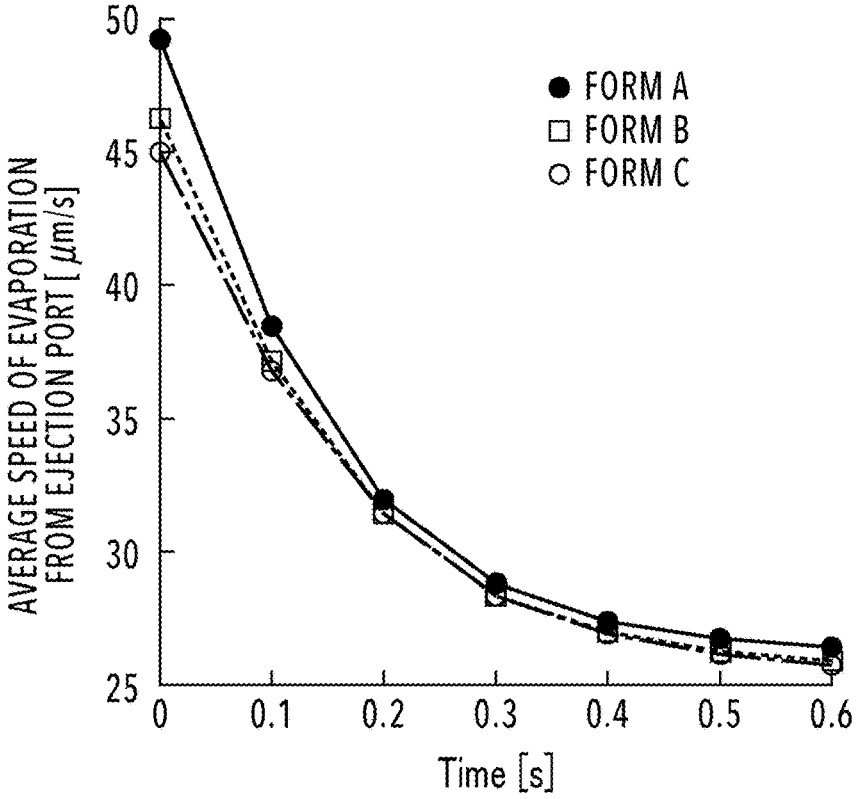
FIGS. 10A and 10B are graphs each illustrating the temporal changes in average evaporation speeds of the volatile component of ink from ejection ports in different print heads.
Figure 11A:
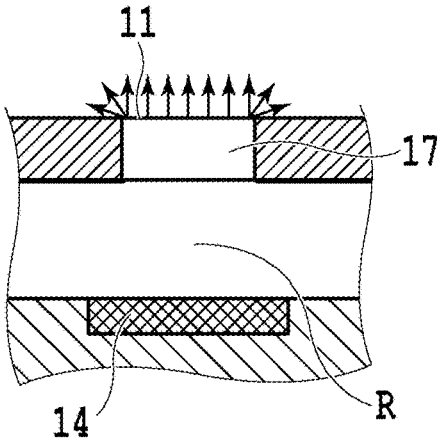
FIGS. 11A, 11B, and 11C are diagrams illustrating the distribution of evaporation speeds of the volatile component of ink from the ejection ports of forms A and B.
Figure 11B:
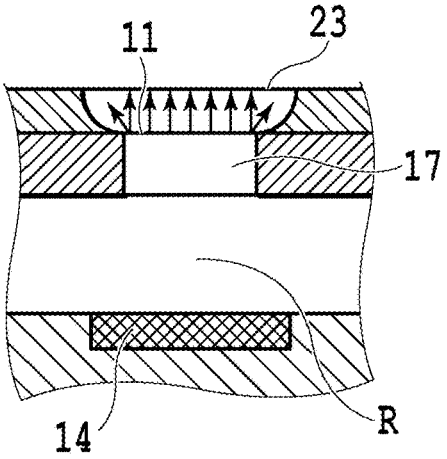

FIG. 10A is a graph illustrating the temporal change in average evaporation speeds of the volatile component of ink from the ejection port in the print head of the flow mode B (J=1.3), and the comparison results of a case where the forms of ejection ports in the print head are set to be forms A, B, and C shown in FIGS. 7A and 7B, FIGS. 8A and 8B, and FIGS. 9A and 9B, respectively. The evaporation rates of the ink volatile component for the forms A, B, and C in an initial stage become lower in the named order. Such a result is caused by the degree of ink diffusivity at the opening edge portion of the ejection port. FIG. 11A and FIG. 11B are diagrams illustrating the degree of ink diffusivity in the ejection ports of the forms A and C as shown in FIGS. 7A and 7B and FIGS. 9A and 9B, respectively. As for those ejection ports of the forms A and C, their degrees of diffusivity of ink located at respective portions other than the opening edge portions of the ejection ports are identical. Meanwhile, as for each of those ejection ports of the forms A and C, an atmosphere area in which ink located at the opening edge portion of the ejection port is apt to be diffused is larger than an atmosphere area in which ink located at a portion other than the opening edge portion of the ejection port is apt to be diffused. For this reason, in each of the ejection ports of the forms A and C, ink located at the opening edge portion of the ejection port is more likely to be diffused than ink located at a portion other than the opening edge portion of the ejection port.

Figure 11C:
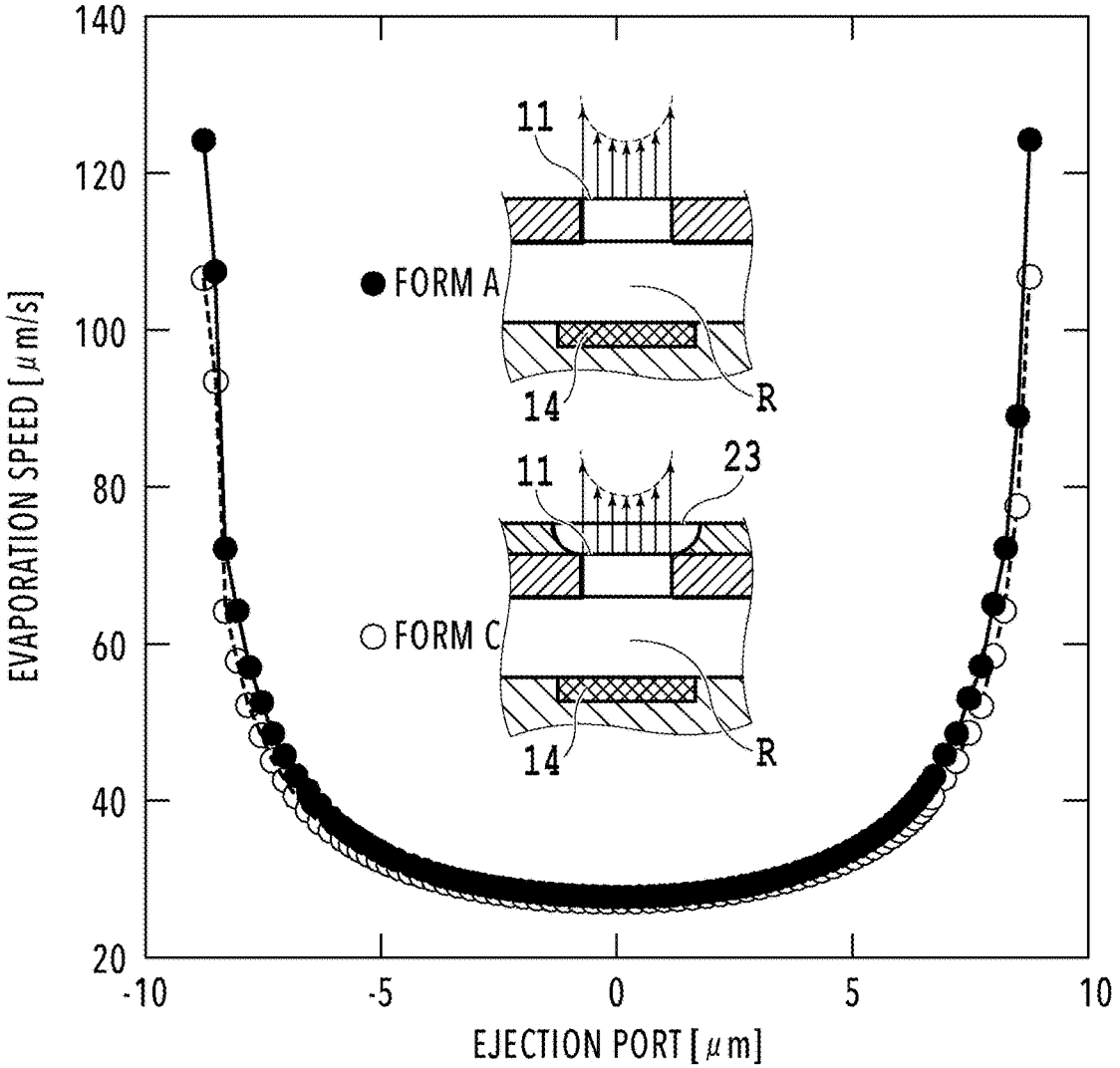

In a case of comparing the ejection ports of the forms A and C, the form C has the second ejection port 23 and the second ejection port part 24, and thus, the atmosphere area in which ink located at the opening edge portion of the ejection port of the form C is apt to be diffused is decreased, and diffusion of such ink is suppressed. FIG. 11C is a diagram illustrating the distribution of evaporation speeds of the volatile component of ink from the ejection ports of the forms A and C. In the form C, the evaporation rate of the volatile component of ink located at the opening edge portion of the ejection port is suppressed. As such, due to the existence of the second ejection port 23 and the second ejection port part 24, the evaporation rate of the ink volatile component at the opening edge portion of the ejection port is suppressed.

Figure 12A:
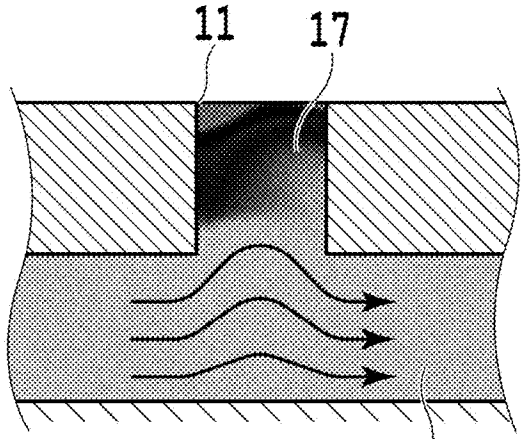
FIGS. 12A, 12B, 12C, and 12D are diagrams illustrating the states of concentrated ink in the ejection ports of forms A and C.
Figure 12B:
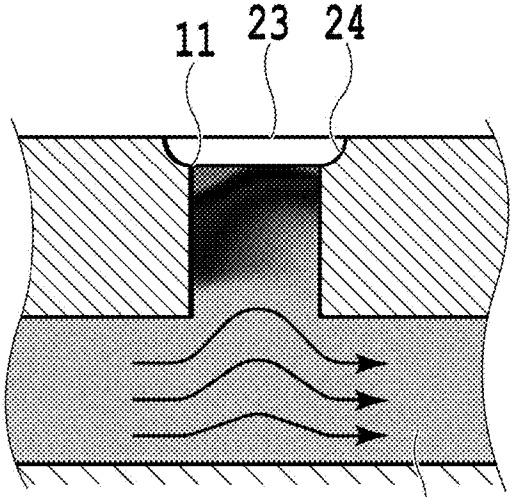

Incidentally, along with the lapse of time, a difference among the evaporation rates of the volatile components of ink from the ejection ports of the forms A, B, and C becomes small. A reason for this is that, as the print head is in the flow mode B, ink inside the ejection port part 17, in particular, the ink in the vicinity of the interface 12 is unlikely to be replaced by the ink circulation flow. FIG. 12A and FIG. 12B are diagrams illustrating the states of concentrated ink in the print heads of the flow mode B in the ejection ports of the forms A and C. In each of the forms A and C, the concentrating of ink in the vicinity of the interface of the ejection port is not resolved, and thus, it is assumed that a difference in the evaporation rates of the volatile component of ink at the opening edge portions of the ejection ports is unlikely to occur as shown in FIG. 11C.

(Print Head of Flow Mode A)

Figure 10B:
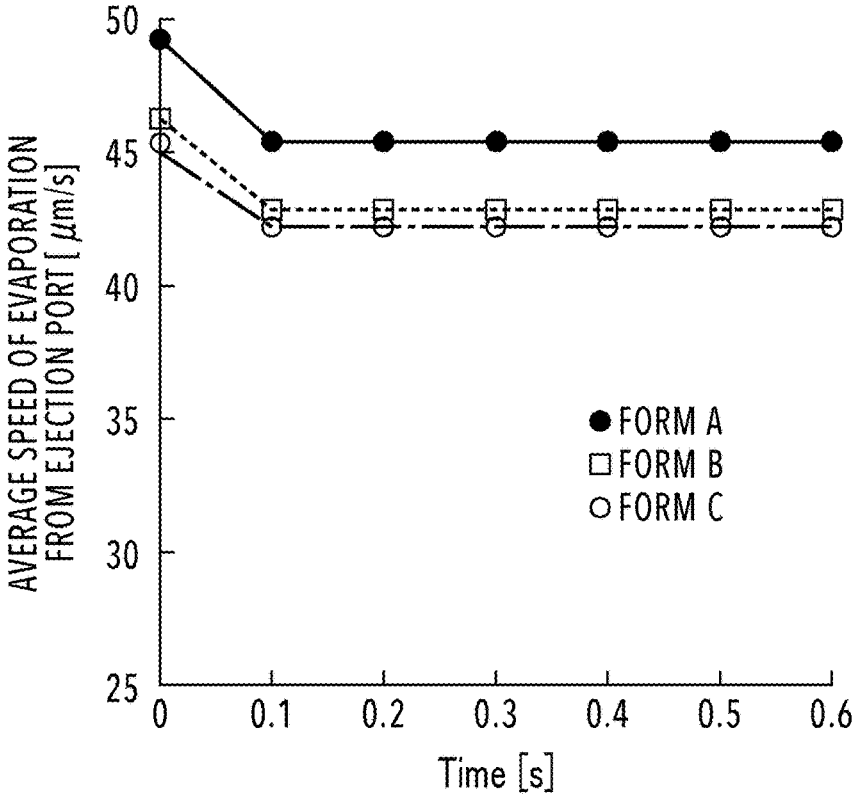
Figure 12C:
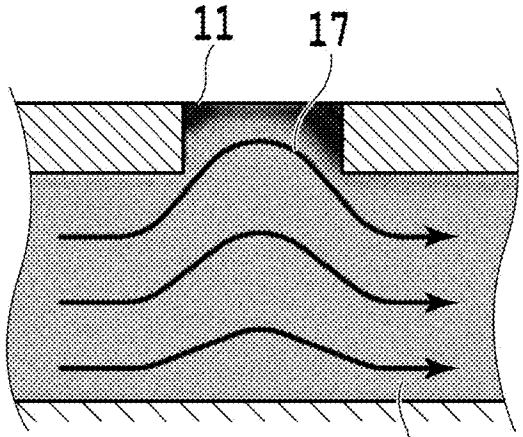
Figure 12D:
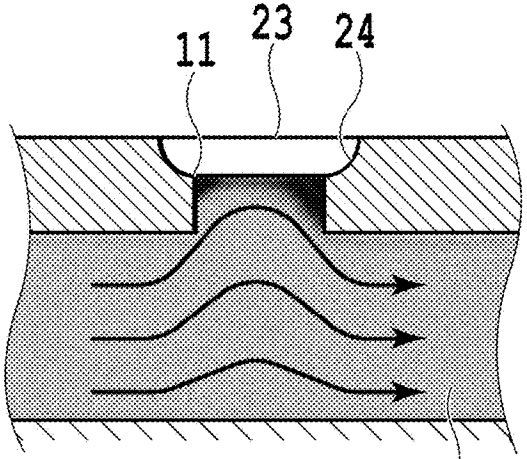
Figure 13A:
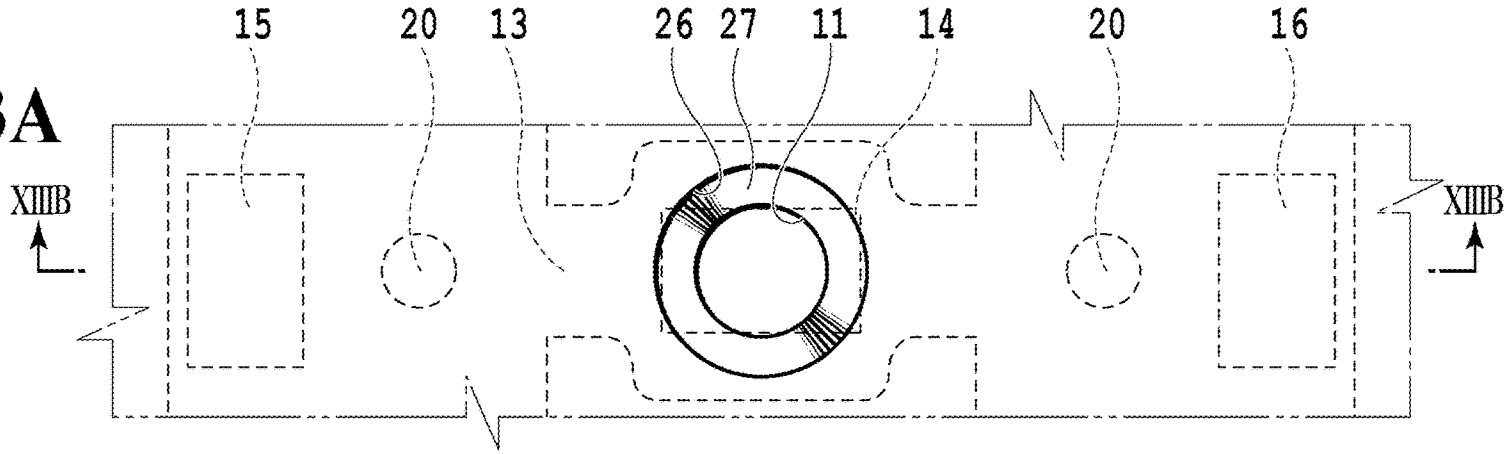
FIGS. 13A and 13B are diagrams each illustrating another embodiment of the ejection port.
Figure 13B:
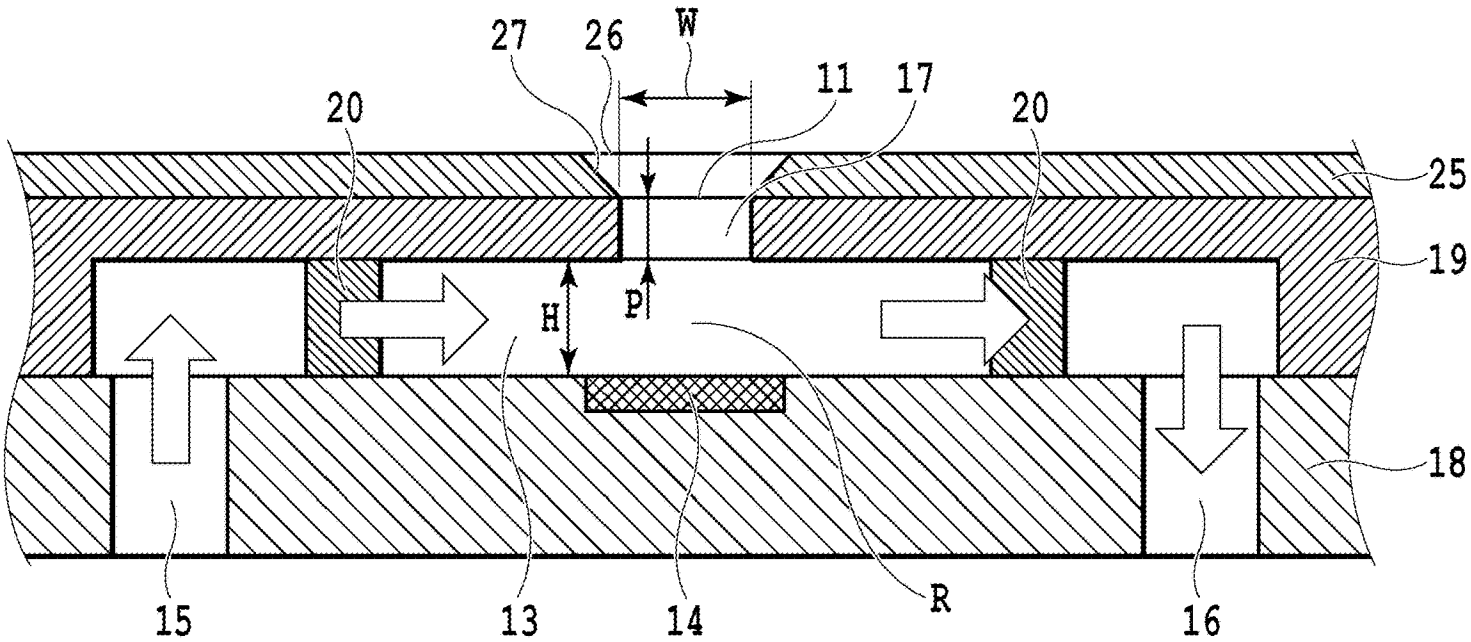

FIG. 10B is a graph illustrating the temporal change in average evaporation speeds of ink from ejection ports in the print head of the flow mode A (J=2.3), and the comparison results of a case where the forms of ejection ports in the print head are set to be forms A, B, and C shown in FIGS. 7A and 7B, FIGS. 8A and 8B, and FIGS. 9A and 9B, respectively. Although a difference in the evaporation rates of the ink volatile component for the forms A, B, and C in an initial stage is similar to the above-described case of FIG. 10A, the difference remains to be large irrespective of the lapse of time. A reason for this is that, as the print head is in the flow mode A, ink in the ejection port part 17, in particular, the ink in the vicinity of the interface 12 is apt to be replaced by the ink circulation flow, and thus, the difference in the evaporation rates of the volatile component of ink at the opening edge portions in the ejection ports of the forms A, B, and C is apt to be apparent. FIG. 12C and FIG. 12D are diagrams illustrating the states of concentrated ink in the print head of the flow mode A in the ejection ports of the forms A and C. Regardless of the print head having the flow mode A, in the case of the form A, the concentrating of ink occurs at the opening edge portion of the ejection port as shown in FIG. 12C. Meanwhile, in the case of the form C, the concentrating of ink is suppressed at the opening edge portion of the ejection port as shown in FIG. 12D. Therefore, normal ejection can be achieved even in a case where the thickening caused by the concentrating of ink at the opening edge portion of the ejection port is less affected, in particular, in a case where the solid content of ink is high (for example, 8% or more).

Figure 14A:
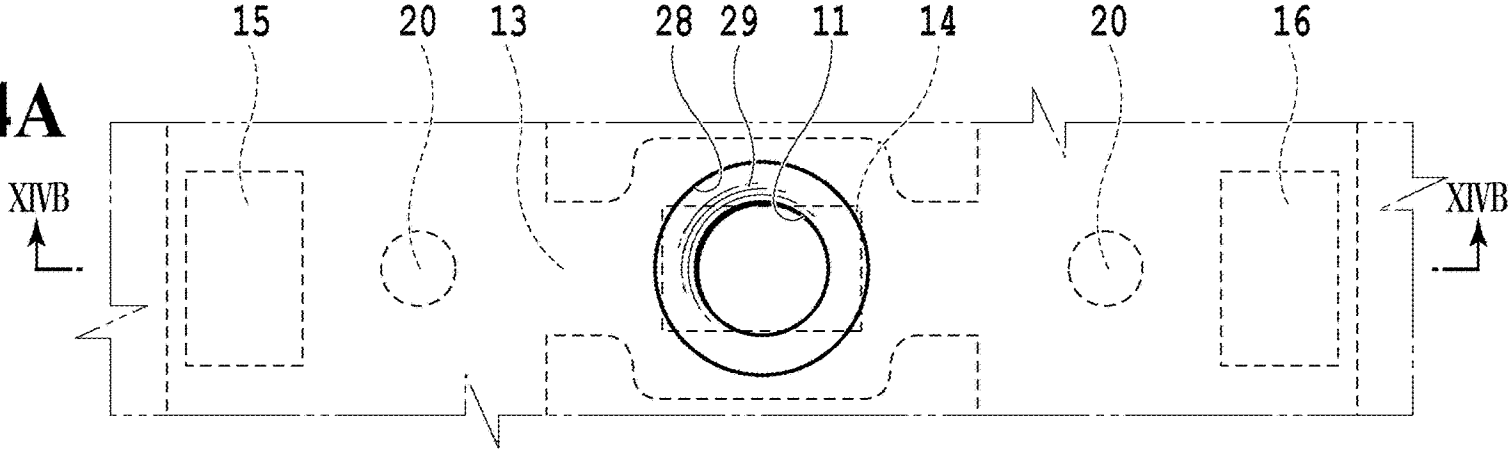
FIGS. 14A and 14B are diagrams each illustrating still another embodiment of the ejection port.
Figure 14B:
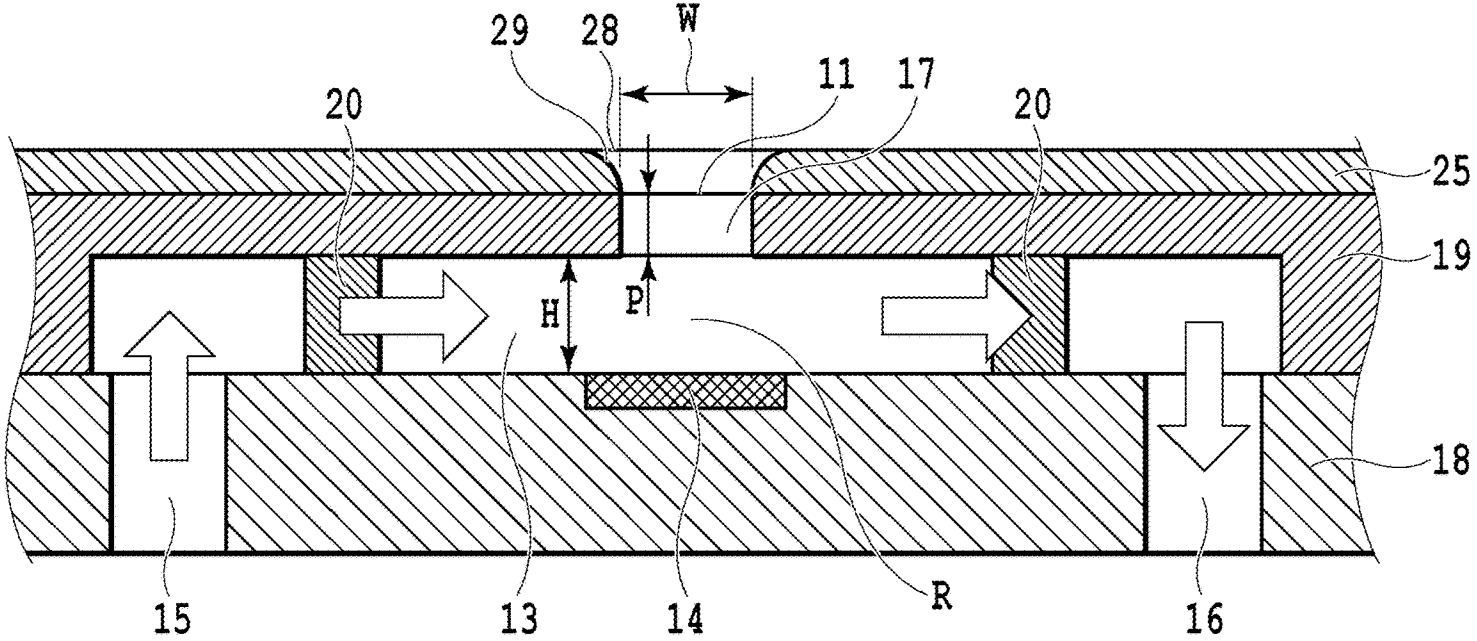
Figure 15A:
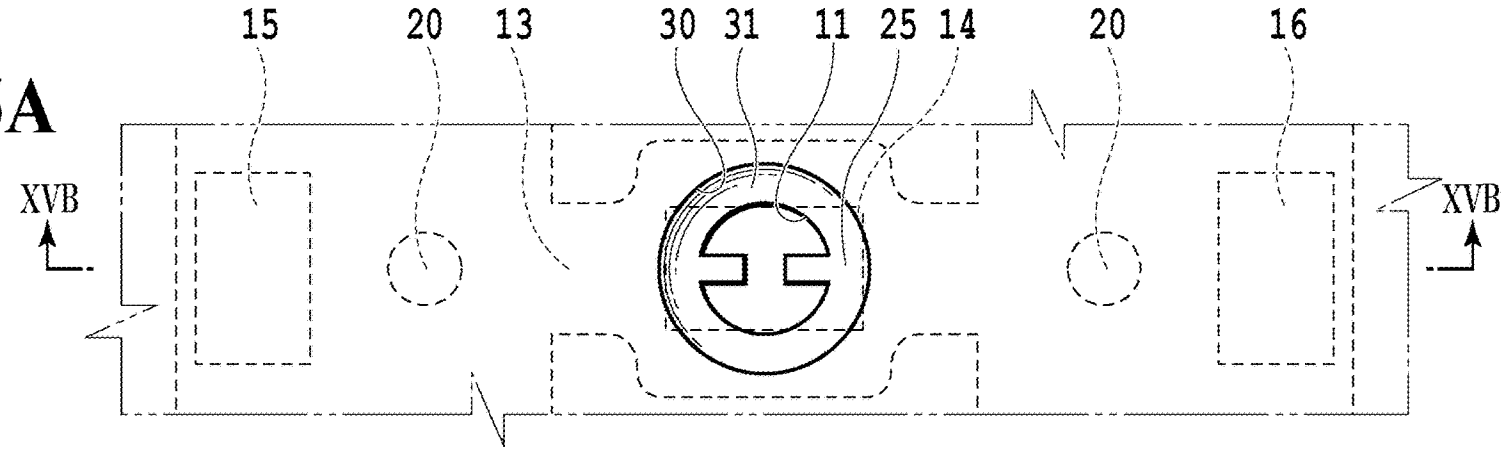
FIGS. 15A and 15B are diagrams each illustrating further another embodiment of the ejection port.
Figure 15B:
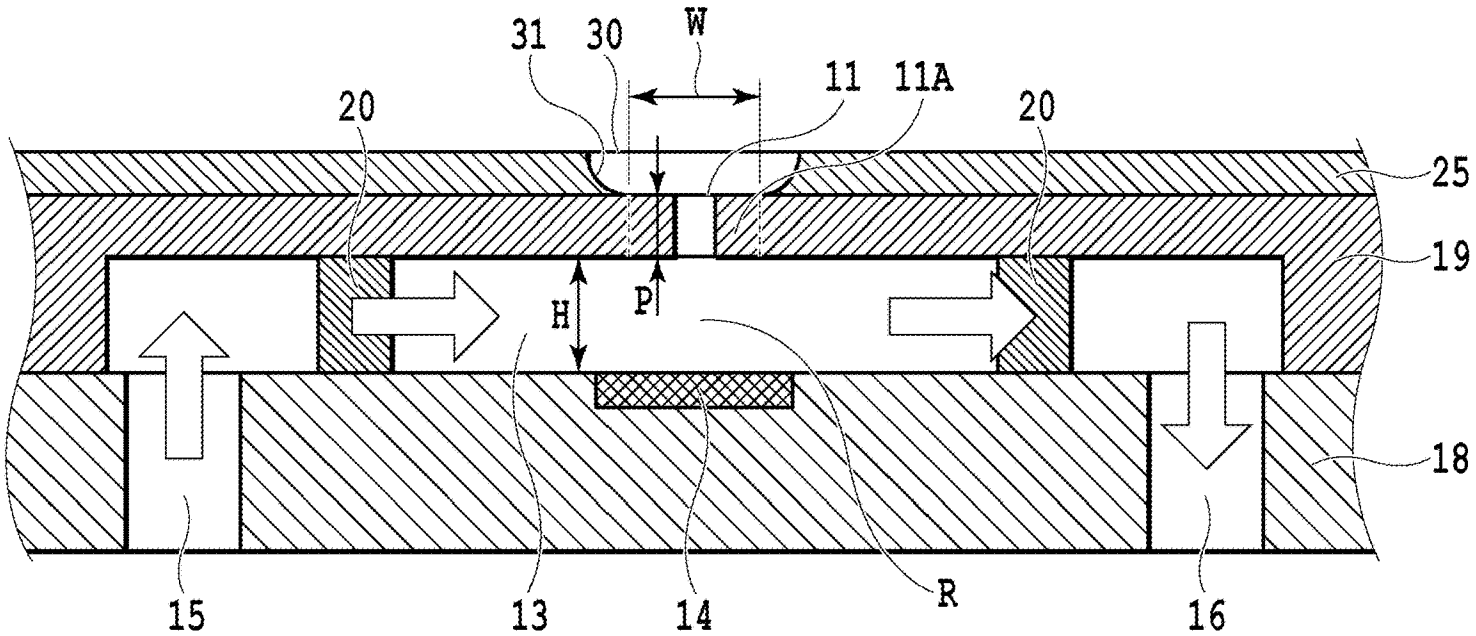

Forms of the second ejection port are not limited only to the forms B and C as shown in FIGS. 8A and 8B and FIGS. 9A and 9B, respectively, but the same effect can be obtained even in the forms shown in, for example, FIGS. 13A and 13B, FIGS. 14A and 14B, and FIGS. 15A and 15B. A second ejection port 26 shown in FIGS. 13A and 13B has a larger diameter than that of the first ejection port 11, and a second ejection port part 27 has a shape in which the inner diameter becomes smaller as it approaches the first ejection port 11 with the inner face of the second ejection port part 27 running along a straight line. A second ejection port 28 shown in FIGS. 14A and 14B has a larger diameter than that of the first ejection port 11, and a second ejection port part 29 has a shape in which the inner diameter becomes smaller as it approaches the first ejection port 11 with the inner face of the second ejection port part 29 depicting a convex curve. Particularly, the second ejection port 28 and the second ejection port part 29 in FIGS. 14A and 14B are effective in suppressing the evaporation of the volatile component of ink from the ejection port. A second ejection port 30 shown in FIGS. 15A and 15B has a larger diameter than that of the first ejection port 11, and a second ejection port part 31 has a shape in which the inner diameter becomes smaller as it approaches the first ejection port 11 with the inner face of the second ejection port part 31 running along a concave curve. As for an opening diameter in the case of an ejection port of a variant shape in place of the circular shape as shown in FIG. 15A, a largest opening diameter of the variant shape is to be considered. Specifically, in the case of the first ejection port 11 in FIGS. 15A and 15B, the relation between an opening diameter of a portion other than two protrusions and an opening diameter of the second ejection port 30 therein are to be considered. The first ejection port 11 in FIGS. 15A and 15B is provided with protrusions 11A facing each other, and the same effect can be obtained by such a structure.

As described in each of the above embodiments, it is preferable that the liquid ejecting head include the first ejection port disposed in an upstream side in an ejecting direction of liquid to be ejected from the ejection port and the second ejection port disposed in a downstream side, and that an opening diameter of the second ejection port be larger than a diameter of the first ejection port. Further, in the ejection port part (second ejection port part) communicating between the first ejection port and the second ejection port, an opening diameter on a second ejection port side should preferably be larger than an opening diameter on a first ejection port side.

OTHER EMBODIMENTS

The present invention may have a configuration such that a liquid ejecting head in which liquid is circulated includes first and second ejection ports disposed in an upstream side and downstream side in a liquid ejecting direction, wherein the second ejection port includes an enlarged diameter portion whose diameter is enlarged in a radially outward manner from at least a part of an opening edge portion of the first ejection port. A second ejection port part communicating between the first ejection port and the second ejection port may include a gap portion as in FIGS. 8A and 8B, and the degree of a gap for the gap portion should desirably be small. The first ejection port may be located at a position where ink meniscus is formed. Further, three or more ejection ports may be configured to be located at positions deviated in the liquid ejecting direction. Such a configuration of the first and second ejection ports allows suppressing thickening of liquid in the vicinity of the ejection port. Furthermore, the relation between a height H, a length P, and a width W may be specified to set a liquid flow mode to be A and thus more securely suppress the liquid thickening in the vicinity of the ejection port.

The present invention can be widely applied to a liquid ejecting head and a liquid ejecting apparatus which eject various kinds of liquid. For instance, a printer, a copying machine, a facsimile machine including a communication system, an apparatus such as a word processor including a printing unit, and further, an industrial printing apparatus combined with various processing apparatuses for multifunctional use such as a 3D printer are applicable. In addition, the present invention can be used for the purpose of biochip fabrication and electronic circuit printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-123087 filed Jun. 23, 2017, which is hereby incorporated by reference herein in its entirety.

What is claimed is:

1. A liquid ejecting head comprising:

a flow path to which liquid flows in through an inflow path and from which the liquid flows out through an outflow path;

a pressure chamber which is located in the flow path;

an ejection port section which is communicated with the pressure chamber; and an ejection energy generating element for causing the liquid in the pressure chamber to be ejected from the ejection port section, wherein the ejection port section includes a first ejection port disposed at an upstream side of the ejection port section with respect to an ejecting direction of liquid and a second ejection port disposed at a downstream side of the ejection port section with respect to the ejecting direction, the second ejection port includes an enlarged diameter portion whose diameter is enlarged in a radially outward manner from at least a part of an opening edge portion of the first ejection port, and in a case in which the height of the flow path upstream of the pressure chamber as measured in a direction parallel to a first flow direction of flow between the pressure chamber and the ejection port section is H (μm), the length of the first ejection port from the pressure chamber to the second ejection port in the ejecting direction is P (μm), and the width of the first ejection port as measured in a direction parallel to a second flow direction of liquid in the pressure chamber from the inflow path to the outflow path is W (μm), the height H, the length P, and the width W satisfy a relation of:

$$H^{-0.34} \times P^{-0.66} \times W > 1.7,$$

wherein the height H is 20 μm or less, the length P is 20 μm or less, and the width W is 30 μm or less.

2. The liquid ejecting head according to claim 1, wherein the enlarged diameter portion is located at an entire perimeter of an opening edge portion of the second ejection port.

3. The liquid ejecting head according to claim 1, wherein a gap portion is provided between the first ejection port and the second ejection port.

4. The liquid ejecting head according to claim 1, wherein a region of the ejection port section between the first ejection port and the second ejection port includes an inclined face which is inclined radially outward along a direction from the first ejection port toward the second ejection port.

5. The liquid ejecting head according to claim 4, wherein the inclined face is a concave curved face.

6. The liquid ejecting head according to claim 4, wherein the inclined face is a convex curved face.

7. The liquid ejecting head according to claim 1, wherein the first ejection port is provided at a position where a meniscus of liquid in the pressure chamber is formed.

8. The liquid ejecting head according to claim 1, wherein a liquid flow through the pressure chamber has a flow rate ranging from 0.1 mm/s to 100 mm/s.

9. The liquid ejecting head according to claim 1, wherein liquid in the pressure chamber has a solid content of 8 wt % or more.

10. The liquid ejecting head according to claim 1, wherein the ejection energy generating element is provided inside the pressure chamber, and the liquid supplied to the pressure chamber through the inflow path is circulated between the pressure chamber and outside the pressure chamber through the outflow path.

11. A liquid ejecting apparatus comprising:

a liquid ejecting head of claim 1;

a liquid supplying flow path for supplying liquid to the liquid ejecting head;

a liquid collecting flow path for collecting liquid from the liquid ejecting head; and a control unit for controlling the ejection energy generating element of the liquid ejecting head.

12. A liquid ejecting head comprising:

a flow path;

a pressure chamber which is located in the flow path;

an ejection port section which is communicated with the pressure chamber;

an ejection energy generating element for causing the liquid in the pressure chamber to be ejected from the ejection port section;

a first flow path which is communicated with the flow path and through which liquid is supplied to the pressure chamber; and a second flow path which is communicated with the flow path and through which liquid is collected from the pressure chamber, wherein the ejection port section includes a first ejection port which is disposed at an upstream side of the ejection port section with respect to an ejecting direction of liquid and in which a liquid meniscus is formed and a second ejection port disposed at a downstream side of the ejection port section with respect to the ejecting direction, an opening diameter of the second ejection port is larger than an opening diameter of the first ejection port, and in a case in which the height of the flow path upstream of the pressure chamber as measured in a direction parallel to a first flow direction of flow between the pressure chamber and the ejection port section is H (μm), the length of the first ejection port from the pressure chamber to the second ejection port in the ejecting direction is P (μm), and the width of the first ejection port as measured in a direction parallel to a second flow direction of liquid in the pressure chamber from the inflow path to the outflow path is W (μm), the height H, the length P, and the width W satisfy a relation of:

$$H^{-0.34} \times P^{-0.66} \times W > 1.7,$$

wherein the height H is 20 μm or less, the length P is 20 μm or less, and the width W is 30 μm or less.

13. The liquid ejecting head according to claim 12, wherein, in a state in which liquid flows from the first flow path to the second flow path via the pressure chamber, the liquid in the pressure chamber forms the liquid meniscus at a position of the first ejection port.

14. The liquid ejecting head according to claim 12, wherein the second ejection port has a larger opening diameter on a downstream side than an opening diameter on an upstream side.

15. The liquid ejecting head according to claim 12, wherein the liquid supplied to the pressure chamber through the first flow path is circulated between the pressure chamber and outside the pressure chamber through the second flow path.

* * * * *